US006161089A

United States Patent [19]

Hardwick

[11] Patent Number: 6,161,089

[45] Date of Patent: Dec. 12, 2000

[54] MULTI-SUBFRAME QUANTIZATION OF SPECTRAL PARAMETERS

[75] Inventor: John C. Hardwick, Somerville, Mass.

[73] Assignee: Digital Voice Systems, Inc., Burlington, Mass.

[21] Appl. No.: 08/818,130

[22] Filed: Mar. 14, 1997

[51] Int. Cl.[7] ..... G10L 21/00

[52] U.S. Cl. ..... 704/230; 704/219; 704/222

[58] Field of Search ..... 704/203, 204, 704/206, 208, 230, 219, 222

[56] References Cited

U.S. PATENT DOCUMENTS

| | | | |
|---|---|---|---|
| 3,706,929 | 12/1972 | Robinson et al. | 325/15 |
| 3,975,587 | 8/1976 | Dunn et al. | 179/1 SA |
| 3,982,070 | 9/1976 | Flanagan | 179/1 SM |
| 4,091,237 | 5/1978 | Wolnowsky et al. | 179/1 SC |
| 4,422,459 | 12/1983 | Simson | 128/702 |
| 4,583,549 | 4/1986 | Manoli | 128/640 |
| 4,618,982 | 10/1986 | Horvath et al. | 381/36 |
| 4,622,680 | 11/1986 | Zinser | 375/25 |
| 4,720,861 | 1/1988 | Bertrand | 381/36 |
| 4,797,926 | 1/1989 | Bronson et al. | 381/36 |
| 4,821,119 | 4/1989 | Gharavi | 358/136 |
| 4,879,748 | 11/1989 | Picone et al. | 381/49 |
| 4,885,790 | 12/1989 | McAulay et al. | 381/36 |
| 4,905,288 | 2/1990 | Gerson et al. | 704/245 |
| 4,979,110 | 12/1990 | Albrecht et al. | 364/413.83 |
| 5,023,910 | 6/1991 | Thomson | 381/37 |
| 5,036,515 | 7/1991 | Freeburg | 371/5.5 |
| 5,054,072 | 10/1991 | McAulay et al. | 381/31 |
| 5,067,158 | 11/1991 | Arjmad | 381/51 |
| 5,081,681 | 1/1992 | Hardwick et al. | 381/51 |
| 5,091,944 | 2/1992 | Takahasi | 381/36 |
| 5,095,392 | 3/1992 | Shimazaki et al. | 360/40 |
| 5,113,448 | 5/1992 | Nomura et al. | 704/219 |
| 5,195,166 | 3/1993 | Hardwick et al. | 395/2 |
| 5,216,747 | 6/1993 | Hardwick et al. | 395/2 |
| 5,226,084 | 7/1993 | Hardwick et al. | 381/41 |
| 5,226,108 | 7/1993 | Hardwick et al. | 395/2 |
| 5,247,579 | 9/1993 | Hardwick et al. | 381/40 |
| 5,265,167 | 11/1993 | Akamine et al. | 381/40 |
| 5,307,441 | 4/1994 | Tzeng | 704/222 |

(List continued on next page.)

FOREIGN PATENT DOCUMENTS

| | | |
|---|---|---|
| 123456 | 10/1984 | European Pat. Off. . |
| 154381 | 9/1985 | European Pat. Off. . |
| 0 422 232 A1 | 4/1991 | European Pat. Off. . |
| 0 577 488 A1 | 1/1994 | European Pat. Off. . |
| 92/05539 | 4/1992 | WIPO . |
| 92/10830 | 6/1992 | WIPO . |
| WO 92/10830 | 6/1992 | WIPO . |
| WO 94/12932 | 6/1994 | WIPO . |
| WO 94/12972 | 6/1994 | WIPO . |

OTHER PUBLICATIONS

Digital Speech Processing, Synthesis, and Recognition by Sadaoki Furui, p62, p135, 1989

(List continued on next page.)

*Primary Examiner*—David R. Hudspeth
*Assistant Examiner*—Daniel Abebe
*Attorney, Agent, or Firm*—Fish & Richardson P.C.

[57] ABSTRACT

Speech is encoded into a frame of bits. A speech signal is digitized into a sequence of digital speech samples that are then divided into a sequence of subframes. A set of model parameters is estimated for each subframe. The model parameters include a set of spectral magnitude parameters that represent spectral information for the subframe. Two or more consecutive subframes from the sequence of subframes may be combined into a frame. The spectral magnitude parameters from both of the subframes within the frame may be jointly quantized. The joint quantization includes forming predicted spectral magnitude parameters from the quantized spectral magnitude parameters from the previous frame, computing the residual parameters as the difference between the spectral magnitude parameters and the predicted spectral magnitude parameters, combining the residual parameters from both of the subframes within the frame, and quantizing the combined residual parameters into a set of encoded spectral bits which are included in the frame of bits.

54 Claims, 7 Drawing Sheets

U.S. PATENT DOCUMENTS

| | | | |
|---|---|---|---|
| 5,517,511 | 5/1996 | Hardwick et al. | 371/37.4 |
| 5,596,659 | 1/1997 | Normile et al. | 382/253 |
| 5,630,011 | 5/1997 | Lim et al. | 704/205 |
| 5,664,053 | 9/1997 | Laflamme et al. | 704/219 |
| 5,696,873 | 12/1997 | Bartkowiak | 704/216 |
| 5,704,003 | 12/1997 | Kleijn et al. | 704/220 |

OTHER PUBLICATIONS

Almeida et al., "Harmonic Coding: A Low Bit–Rate, Good–Quality Speech Coding Technique," IEEE (1982), pp. 1664–1667.

Almeida, et al. "Variable–Frequency Synthesis: An Improved Harmonic Coding Sheme", ICASSP (1984), pp. 27.5.1–27.5.4.

Atungsiri et al., "Error Detection and Control for the Parametric Information in CELP Coders", IEEE (1990), pp. 229–232.

Brandstein et al., "A Real–Time Implementation of the Improved MBE Speech Coder", IEEE (1900), pp. 5–8

Campbell et al., "The New 4800 bps Voice Coding Standard", Mil Speeh Tech Conference (Nov. 1989), pp. 64–70.

Chen et al., "Real–Time Vector APC Speech Coding at 4800 bps with Adaptive Postifiltering", Proc. ICASSP (1987), pp. 2185–2188.

Cox et al., "Subband Speech Coding and Matched Convolutional Channel Coding for Mobile Radio Channels," IEEE Trans. Signal Proc., vol. 39, No. 8 (Aug. 1991), pp. 1717–1731.

Digital Voice Systems, Inc., "INMARSAT–M Voice Codec", Version 1.9 (Nov. 18, 1992), pp. 1–145.

Digital Voice Systems, Inc., "The DVSI IMBE Speech Compression System," advertising brochure (May 12, 1993).

Digital Voice Systems, Inc., "The DVSI IMBE Speech Coder," advertising brochure (May 12, 1993).

Flanagan, J.L., Speech Analysis Synthesis and Perception, Springer–Verlag (1982), pp. 378–386.

Fujimura, "An Approximation to Voice Aperiodicity", IEEE Transactions on Audio and Electroacoutics, vol. AU–16, No. 1 (Mar. 1968), pp. 68–72.

Griffin, et al., "A High Quality 9.6 Kbps Speech Coding System", Proc. ICASSP 86, Tokyo, Japan, (Apr. 13–20, 1986), pp. 125–128.

Griffin et al., "A New Model–Based Speech Analysis/Synthesis System", Proc. ICASSP 85, Tampa, FL (Mar. 26–29, 1985), pp. 513–516.

Griffin, et al. "A New Pitch Detection Algorithm", Digital Signal Processing, No. 84, Elsevier Science Publishers (1984), pp. 395–399.

Griffin et al., "Multiband Excitation Vocoder" IEEE Transactions on Acoustics, Speech and Signal Processing, vol. 36, No. 8 (1988), pp. 1223–1235.

Griffin, "The Multiband Excitation Vocoder", Ph.D. Thesis, M.I.T., 1987.

Griffin et al. "Signal Estimation from Modified Short–Time Fourier Transform", IEEE Transactions on Acoustics, Speech, and Signal Processing, vol. ASSP–32, No. 2 (Apr. 1984), pp. 236–243.

Hardwick et al. "A 4.8 Kbps Multi–band Excitation Speech Coder, " Proceedings from ICASSP, International Conference on Acoustics, Speech and Signal Processing, New York, N.Y. (Apr. 11–14, 1988), pp. 374–377.

Hardwick et al. "A 4.8 Kbps Multi–Band Excitation Speech Coder," Master's Thesis, M.I.T., 1988.

Hardwick et al. "The Application of the IMBE Speech Coder to Mobile Communications," IEEE (1991), pp. 249–252.

Heron, "A 32–Band Sub–band/Transform Coder Incorporating Vector Quantization for Dynamic Bit Allocation", IEEE (1983), pp. 1276–1279.

Levesque et al., "A Proposed Federal Standard for Narrowband Digital Land Mobile Radio", IEEE (1990), pp. 497–501.

Makhoul, "A Mixed–Source Model For Speech Compression and Synthesis", IEEE (1978), p. 163–166.

Makhoul et al., "Vector Quantization in Speech Coding", Proc. IEEE (1985), pp. 1551–1588.

Maragos et al., "Speech Nonlinearities, Modulations, and Energy Operators", IEEE (1991), pp. 421–424.

Mazor et al., "Transform Subbands Coding With Channel Error Control", IEEE (1989), pp. 172–175.

McAulay et al., "Mid–Rate Coding Based on a Sinusoidal Representation of Speech", Proc. IEEE (1985), pp. 945–948.

McAulay et al., Multirate Sinusoidal Transform Coding at Rates from 2.4 Kbps to 8 Kbps., IEEE (1987), pp. 1645–1648.

McAulay et al., "Speech Analysis/Synthesis Based on a Sinusoidal Representation," IEEE Transactions on Acoustics, Speech and Signal Processing V. 34, No. 4, (Aug. 1986), pp. 744–754.

McCree et al., "A New Mixed Excitation LPC Vocoder", IEEE (1991), pp. 593–595.

McCree et al., "Improving the Performance of a Mixed Excitation LPC Vocoder in Acoustic Noise", IEEE (1992), pp. 137–139.

Rahikka et al., "CELP Coding for Land Mobile Radio Applications," Proc. ICASSP 90, Albuquerque, New Mexico, Apr. 3–6, 1990, pp. 465–468.

Rowe et al., "A robust 2400bit/s MBE–LPC Speech Coder Incorporating Joint Source and Channel Coding," IEEE (1992), pp. 141–144.

Secrest, et al., "Postprocessing Techniques for Voice Pitch Trackers", ICASSP, vol. 1 (1982), pp. 172–175.

Tribolet et al., Frequency Domain Coding of Speech, IEEE Transactions on Acoustics, Speech and Signal Processing, V. ASSP–27, No. 5, pp 512–530 (Oct. 1979).

Yu et al., "Discriminant Analysis and Supervised Vector Quantization for Continuous Speech Recognition", IEEE (1990), pp. 685–688.

MULTI-SUBFRAME QUANTIZATION OF SPECTRAL PARAMETERS

BACKGROUND

The invention is directed to encoding and decoding speech.

Speech encoding and decoding have a large number of applications and have been studied extensively. In general, one type of speech coding, referred to as speech compression, seeks to reduce the data rate needed to represent a speech signal without substantially reducing the quality or intelligibility of the speech. Speech compression techniques may be implemented by a speech coder.

A speech coder is generally viewed as including an encoder and a decoder. The encoder produces a compressed stream of bits from a digital representation of speech, such as may be generated by converting an analog signal produced by a microphone using an analog-to-digital converter. The decoder converts the compressed bit stream into a digital representation of speech that is suitable for playback through a digital-to-analog converter and a speaker. In many applications, the encoder and decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at high rates (greater than 8 kbs), mid-rates (3–8 kbs) and low rates (less than 3 kbs). Recently, mid-rate and low-rate speech coders have received attention with respect to a wide range of mobile communication applications (e.g., cellular telephony, satellite telephony, land mobile radio, and in-flight telephony). These applications typically require high quality speech and robustness to artifacts caused by acoustic noise and channel noise (e.g., bit errors).

Vocoders are a class of speech coders that have been shown to be highly applicable to mobile communications. A vocoder models speech as the response of a system to excitation over short time intervals. Examples of vocoder systems include linear prediction vocoders, homomorphic vocoders, channel vocoders, sinusoidal transform coders ("STC"), multiband excitation ("MBE") vocoders, and improved multiband excitation ("IMBE™") vocoders. In these vocoders, speech is divided into short segments (typically 10–40 ms) with each segment being characterized by a set of model parameters. These parameters typically represent a few basic elements of each speech segment, such as the segment's pitch, voicing state, and spectral envelope. A vocoder may use one of a number of known representations for each of these parameters. For example the pitch may be represented as a pitch period, a fundamental frequency, or a long-term prediction delay. Similarly the voicing state may be represented by one or more voiced/unvoiced decisions, by a voicing probability measure, or by a ratio of periodic to stochastic energy. The spectral envelope is often represented by an all-pole filter response, but also may be represented by a set of spectral magnitudes or other spectral measurements.

Since they permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

One speech model which has been shown to provide high quality speech and to work well at medium to low bit rates is the Multi-Band Excitation (MBE) speech model developed by Griffin and Lim. This model uses a flexible voicing structure that allows it to produce more natural sounding speech, and which makes it more robust to the presence of acoustic background noise. These properties have caused the MBE speech model to be employed in a number of commercial mobile communication applications.

The MBE speech model represents segments of speech using a fundamental frequency, a set of binary voiced/unvoiced (V/UV) metrics, and a set of spectral magnitudes. A primary advantage of the MBE model over more traditional models is in the voicing representation. The MBE model generalizes the traditional single V/UV decision per segment into a set of decisions, each representing the voicing state within a particular frequency band. This added flexibility in the voicing model allows the MBE model to better accommodate mixed voicing sounds, such as some voiced fricatives. In addition this added flexibility allows a more accurate representation of speech that has been corrupted by acoustic background noise. Extensive testing has shown that this generalization results in improved voice quality and intelligibility.

The encoder of an MBE-based speech coder estimates the set of model parameters for each speech segment. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes before interleaving and transmitting the resulting bit stream to a corresponding decoder.

The decoder converts the received bit stream back into individual frames. As part of this conversion, the decoder may perform deinterleaving and error control decoding to correct or detect bit errors. The decoder then uses the frames of bits to reconstruct the MBE model parameters, which the decoder uses to synthesize a speech signal that perceptually resembles the original speech to a high degree. The decoder may synthesize separate voiced and unvoiced components, and then may add the voiced and unvoiced components to produce the final speech signal.

In MBE-based systems, the encoder uses a spectral magnitude to represent the spectral envelope at each harmonic of the estimated fundamental frequency. Typically each harmonic is labeled as being either voiced or unvoiced, depending upon whether the frequency band containing the corresponding harmonic has been declared voiced or unvoiced. The encoder then estimates a spectral magnitude for each harmonic frequency. When a harmonic frequency has been labeled as being voiced, the encoder may use a magnitude estimator that differs from the magnitude estimator used when a harmonic frequency has been labeled as being unvoiced. At the decoder, the voiced and unvoiced harmonics are identified, and separate voiced and unvoiced components are synthesized using different procedures. The unvoiced component may be synthesized using a weighted overlap-add method to filter a white noise signal. The filter is set to zero all frequency regions declared voiced while otherwise matching the spectral magnitudes labeled unvoiced. The voiced component is synthesized using a tuned oscillator bank, with one oscillator assigned to each harmonic that has been labeled as being voiced. The instantaneous amplitude, frequency and phase are interpolated to match the corresponding parameters at neighboring segments.

MBE-based speech coders include the IMBE™ speech coder and the AMBE® speech coder. The AMBE® speech coder was developed as an improvement on earlier MBE-based techniques. It includes a more robust method of estimating the excitation parameters (fundamental frequency and V/UV decisions) which is better able to track the variations and noise found in actual speech. The AMBE® speech coder uses a filterbank that typically includes sixteen channels and a non-linearity to produce a set of channel outputs from which the excitation parameters can be reliably estimated. The channel outputs are combined and processed to estimate the fundamental frequency and then the channels within each of several (e.g., eight) voicing bands are processed to estimate a V/UV decision (or other voicing metric) for each voicing band.

The AMBE® speech coder also may estimate the spectral magnitudes independently of the voicing decisions. To do this, the speech coder computes a fast Fourier transform ("FFT") for each windowed subframe of speech and then averages the energy over frequency regions that are multiples of the estimated fundamental frequency. This approach may further include compensation to remove from the estimated spectral magnitudes artifacts introduced by the FFT sampling grid.

The AMBE® speech coder also may include a phase synthesis component that regenerates the phase information used in the synthesis of voiced speech without explicitly transmitting the phase information from the encoder to the decoder. Random phase synthesis based upon the V/UV decisions may be applied, as in the case of the IMBE™ speech coder. Alternatively, the decoder may apply a smoothing kernel to the reconstructed spectral magnitudes to produce phase information that may be perceptually closer to that of the original speech than is the randomly-produced phase information.

The techniques noted above are described, for example, in Flanagan, *Speech Analysis, Synthesis and Perception,* Springer-Verlag, 1972, pages 378–386 (describing a frequency-based speech analysis-synthesis system); Jayant et al., *Digital Coding of Waveforms,* Prentice-Hall, 1984 (describing speech coding in general); U.S. Pat. No. 4,885,790 (describing a sinusoidal processing method); U.S. Pat. No. 5,054,072 (describing a sinusoidal coding method); Almeida et al., "Nonstationary Modeling of Voiced Speech", *IEEE TASSP,* Vol. ASSP-31, No. 3, June 1983, pages 664–677 (describing harmonic modeling and an associated coder); Almeida et al., "Variable-Frequency Synthesis: An Improved Harmonic Coding Scheme", *IEEE Proc. ICASSP* 84, pages 27.5.1–27.5.4 (describing a polynomial voiced synthesis method); Quatieri et al., "Speech Transformations Based on a Sinusoidal Representation", *IEEE TASSP, Vol, ASSP*34, No. 6, Dec. 1986, pages 1449–1986 (describing an analysis-synthesis technique based on a sinusoidal representation); McAulay et al., "Mid-Rate Coding Based on a Sinusoidal Representation of Speech", Proc. *ICASSP* 85, pages 945–948, Tampa, Fla., March 26–29, 1985 (describing a sinusoidal transform speech coder); Griffin, "Multiband Excitation Vocoder", Ph.D. Thesis, M.I.T, 1987 (describing the Multi-Band Excitation (MBE) speech model and an 8000 bps MBE speech coder); Hardwick, "A 4.8 kbps Multi-Band Excitation Speech Coder", SM. Thesis, M.I.T, May 1988 (describing a 4800 bps Multi-Band Excitation speech coder); Telecommunications Industry Association (TIA), "APCO Project 25 Vocoder Description", Version 1.3, Jul. 15, 1993, IS102BABA (describing a 7.2 kbps IMBE™ speech coder for APCO Project 25 standard); U.S. Pat. No. 5,081,681 (describing IMBE™ random phase synthesis); U.S. Pat. No. 5,247,579 (describing a channel error mitigation method and format enhancement method for MBE-based speech coders); U.S. Pat. No. 5,226,084 (describing quantization and error mitigation methods for MBE-based speech coders); U.S. Pat. No. 5,517,511 (describing bit prioritization and FEC error control methods for MBE-based speech coders).

SUMMARY

The invention features a new AMBE® speech coder for use, for example, in a wireless communication system to produce high quality speech from a bit stream transmitted across a wireless communication channel at a low data rate. The speech coder combines low data rate, high voice quality, and robustness to background noise and channel errors. This promises to advance the state of the art in speech coding for mobile communications. The new speech coder achieves high performance through a new multi-subframe spectral magnitude quantizer that jointly quantizes spectral magnitudes estimated from two or more consecutive subframes. The quantizer achieves fidelity comparable to prior art systems while using fewer bits to quantize the spectral magnitude parameters. AMBE® speech coders are described generally in U.S. application Ser. No. 08/222,119, filed Apr. 4, 1994 and entitled "ESTIMATION OF EXCITATION PARAMETERS"; U.S. application Ser. No. 08/392,188, filed Feb. 22, 1995 and entitled "SPECTRAL REPRESENTATIONS FOR MULTI-BAND EXCITATION SPEECH CODERS"; and U.S. Application No. 08/392,099, filed Feb. 22, 1995 and entitled "SYNTHESIS OF SPEECH USING REGENERATED PHASE INFORMATION", all of which are incorporated by reference.

In one aspect, generally, the invention features encoding speech into a frame of bits. A speech signal is digitized into a sequence of digital speech samples that are divided into a sequence of subframes, each of which includes multiple digital speech samples. A set of speech model parameters is estimated for each subframe, the parameters including a set of spectral magnitude parameters that represent spectral information for the subframe. Consecutive subframes then are combined into a frame, and the spectral magnitude parameters from the subframes of the frame are jointly quantized to produce a set of encoder spectral bits that are included in a frame of bits for transmission or storage. The joint quantization includes forming predicted spectral magnitude parameters from quantized spectral magnitude parameters from a previous frame.

Embodiments of the invention may include one or more of the following features. The joint quantization may include computing residual parameters as the difference between the spectral magnitude parameters and the predicted spectral magnitude parameters. The residual parameters from the subframes of the frame may be combined and quantized into a set of encoder spectral bits.

The residual parameters may be combined by dividing the residual parameters from each subframe into frequency blocks and performing a linear transformation on the residual parameters within each frequency block to produce a set of transformed residual coefficients for each subframe. A minority of the transformed residual coefficients from the frequency blocks for each subframe may be grouped into a PRBA vector for the subframe, and the remaining transformed residual coefficients for each frequency block of each subframe may be grouped into a higher order coefficient (HOC) vector for the frequency block. The prediction residual block average (PRBA) vectors may be transformed to produce a transformed PRBA vector for each subframe, and the transformed PRBA vectors for the subframes of the frame may be combined by computing generalized sum and difference vectors from the transformed PRBA vectors, and combining the HOC vectors within each frequency block for the subframes of the frame by computing generalized sum and difference vectors from the HOC vectors for each frequency block.

The predicted spectral magnitude parameters may be formed by applying a gain of less than unity to a linear interpolation of quantized spectral magnitudes from a last subframe in a previous frame. The transformed residual coefficients may be computed for each frequency block using a Discrete Cosine Transform (DCT) followed by a linear two by two transform on two lowest order DCT coefficients. The length of each frequency block may be approximately proportional to a number of spectral magnitude parameters within the subframe.

The combined residual parameters may be quantized using a vector quantizer. Vector quantization may be applied to all or part of the generalized sum and difference vectors computed from the transformed PRBA vectors, and may be applied to all or part of the generalized sum and difference vectors computed from the HOC vectors.

Additional encoder bits may be produced by quantizing additional speech model parameters other than the spectral magnitude parameters. The additional speech model parameters may include parameters representative of a fundamental frequency and parameters representative of a voicing state. The frame of bits also may include redundant error control bits that protect at least some of the encoder spectral bits. The spectral magnitude parameters may represent log spectral magnitudes estimated for a Multi-Band Excitation (MBE) speech model, and may be estimated from a computed spectrum in a manner which is independent of a voicing state.

In another aspect, generally, the invention features decoding speech from a frame of bits. Decoder spectral bits are extracted from the frame of bits, and are used to jointly reconstruct spectral magnitude parameters for consecutive subframes within a frame of speech. The joint reconstruction includes inverse quantizing the decoder spectral bits to reconstruct a set of combined residual parameters for the frame from which separate residual parameters for each of the subframes are computed. Predicted spectral magnitude parameters are formed from reconstructed spectral magnitude parameters from a previous frame. The separate residual parameters are added to the predicted spectral magnitude parameters to form the reconstructed spectral magnitude parameters for each subframe within the frame. Digital speech samples are synthesized for each subframe using speech model parameters that include some or all of the reconstructed spectral magnitude parameters for the subframe.

Embodiments of this aspect of the invention may include one or more of the following features. The separate residual parameters may be computed by dividing each subframe into frequency blocks. The combined residual parameters for the frame may be separated into generalized sum and difference vectors representing transformed PRBA vectors combined across the subframes of the frame, and into generalized sum and difference vectors representing HOC vectors for the frequency blocks combined across the subframes of the frame. PRBA vectors may be computed for each subframe from the generalized sum and difference vectors representing the transformed PRBA vectors. HOC vectors may be computed for each subframe from the generalized sum and difference vectors representing the HOC vectors for each of the frequency blocks. The PRBA vector and the HOC vectors for each of the frequency blocks may be combined to form transformed residual coefficients for each of the subframes, and an inverse transformation may be performed on the transformed residual coefficients to produce the separate residual parameters for each subframe of the frame.

The predicted spectral magnitude parameters may be formed by applying a gain of less than unity to a linear interpolation of quantized spectral magnitudes from a last subframe of a previous frame. The separate residual parameters may be computed from the transformed residual coefficients by performing on each of the frequency blocks an inverse linear two by two transform on the two lowest order transformed residual coefficients within the frequency block and then performing an Inverse Discrete Cosine Transform (IDCT) over all the transformed residual coefficients within the frequency block.

Four of the frequency blocks may be used per subframe, and the length of each frequency block may be approximately proportional to a number of spectral magnitude parameters within the subframe. Inverse quantization to reconstruct a set of combined residual parameters for the frame may include using inverse vector quantization applied to one or more vectors.

The frame of bits may include other decoder bits in addition to the decoder spectral bits. These bits may be representative of speech model parameters other than the spectral magnitude parameters, such as a fundamental frequency and parameters representative of a voicing state. The frame of bits also may include redundant error control bits protecting at least some of the decoder spectral bits.

The reconstructed spectral magnitude parameters may represent log spectral magnitudes used in a Multi-Band Excitation (MBE) speech model. Synthesizing of speech for each subframe may include computing a set of phase parameters from the reconstructed spectral magnitude parameters.

In another aspect, the invention features encoding a level of speech into a frame of bits by digitizing a speech signal into a sequence of digital speech samples and dividing the digital speech samples into a sequence of subframes that each include multiple digital speech samples. A speech level parameter is estimated for each subframe. The speech level parameter is representative of the amplitude of the digital speech samples of the subframe. Consecutive subframes are combined into a frame, and the speech level parameters from the subframes within the frame are jointly quantized. This quantization includes computing and quantizing an average level parameter by combining the speech level parameters over the subframes within the frame, and computing and quantizing a difference level vector between the speech level parameters for each subframe within the frame and the average level parameter. Quantized bits representative of the average level parameter and the difference level vector are included in a frame of bits.

Embodiments of this aspect of the invention may include one or more of the following features. The speech level parameter for each subframe may be estimated as a mean of a set of spectral magnitude parameters computed for each subframe plus an offset. The spectral magnitude parameters may represent log spectral magnitudes estimated for a Multi-Band Excitation (MBE) speech model. The offset may be dependent on a number of spectral magnitude parameters in the frame.

The difference level vector may be quantized using vector quantization, and the frame of bits may include error control bits used to protect some or all of the quantized bits representative of the average level parameter and the difference level vector.

Other features and advantages of the invention will be apparent from the following description, including the drawings, and from the claims.

DESCRIPTION

Figure 1:
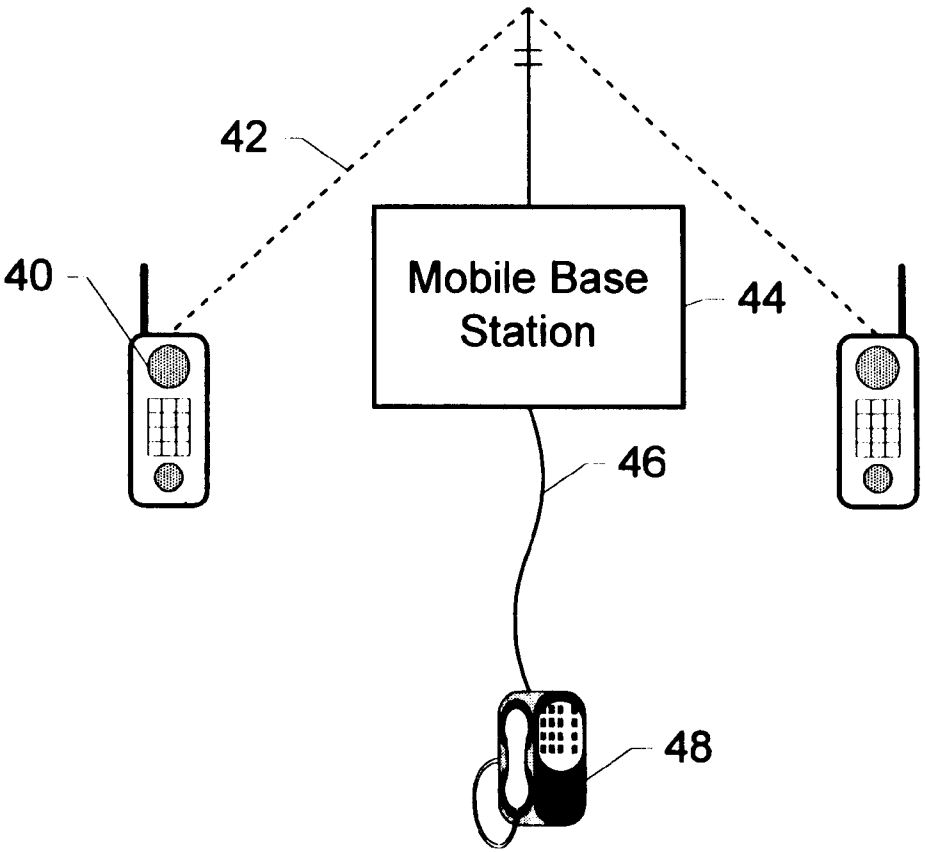
FIG. 1 is a simplified block diagram of a wireless communications system.

An embodiment of the invention is described in the context of a new AMBE® speech coder, or vocoder, which is widely applicable to the problems of wireless communications such as cellular or satellite telephony, mobile radio, airphones, voice pagers, and digital storage of speech such as in telephone answering machines and dictation equipment. Referring to FIG. 1, a mobile terminal or telephone 40 is connected across a wireless communication channel 42 to a mobile gateway or base station 44 which is connected to the public switched telephone network (PSTN) 46. The speech coder in the mobile telephone 40 and in the mobile base station 44 allows conventional telephones 48 to be bridged into the wireless network.

The described vocoder has a 40 ms frame size and operates at a data rate of 3900 bps (156 bits per frame). These bits are divided between speech coding and forward error control ("FEC") coding to increase the robustness of the system to bit errors that normally occur across a wireless communication channel. The vocoder is designed to operate most efficiently at low to medium data rates in which speech is coded and transmitted at rates of 1500 bps to 8000 bps, ignoring bits associated with FEC coding. However, appropriate modifications can be made to the vocoder to enable it to work at other data rates. The vocoder also may be adapted to other frame sizes, such as, for example, 30–60 ms frames. In one implementation, a dual-rate embodiment using a 45 ms frame size has been operated at data rates of 3467 bps and 6933 bps.

Figure 2:
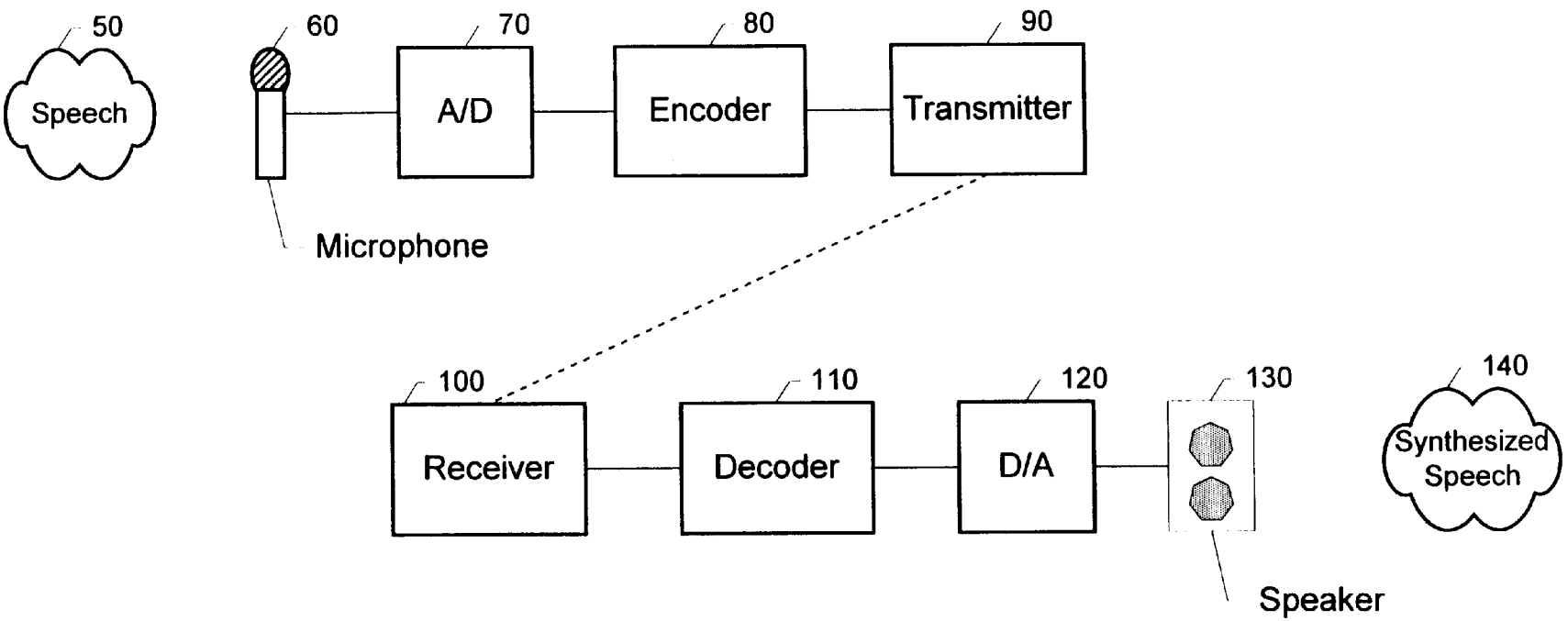
FIG. 2 is a block diagram of a communication link of the system of FIG. 1.

Referring to FIG. 2, the mobile telephone at the transmitting end achieves voice communication by digitizing speech 50 received through a microphone 60 using an analog-to-digital (A/D) converter 70 that samples the speech at a frequency of 8 kHz. The digitized speech signal passes through a speech encoder 80, where it is processed as described below. The signal is then transmitted across the communication link by a transmitter 90. At the other end of the communication link, a receiver 100 receives the signal and passes it to a decoder 110. The decoder converts the signal into a synthetic digital speech signal. A digital-to-analog (D/A) converter 120 then converts the synthetic digital speech signal into an analog speech signal that is converted into audible speech 140 by a speaker 130.

Figure 3:
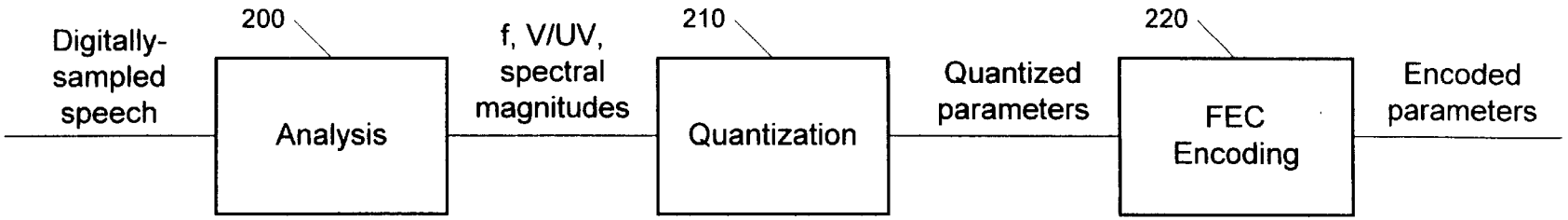
FIGS. 3 and 4 are block diagrams of an encoder and a decoder of the system of FIG. 1.
Figure 4:
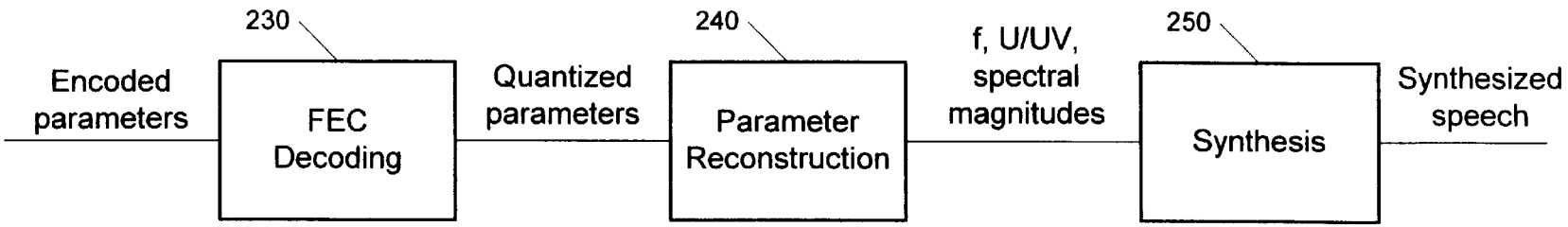

The speech coder in each terminal includes an encoder 80 and a decoder 110. As shown in FIG. 3, the encoder includes three main functional blocks: speech analysis 200, parameter quantization 210, and FEC encoding 220. FEC encoding typically includes bit prioritization and interleaving. As shown in FIG. 4, the decoder is similarly divided into FEC decoding 230, which may include deinterleaving and inverse bit prioritization, parameter reconstruction 240 (i.e., inverse quantization) and speech synthesis 250.

The speech coder may be designed to operate at multiple data rates. However, the described embodiment is a 3900 bps vocoder using 156 bits per 40 ms frame. These bits are divided into 103 bits used for the voice (i.e. source) coding plus 53 bits used for forward error correction (FEC) coding. Each 40 ms frame is divided into two 20 ms subframes, and speech analysis and synthesis are performed on a subframe basis while quantization and FEC coding are performed on a frame basis.

The FEC typically includes one or more short block codes and/or convolution codes. In the described embodiment, one [24,12] extended Golay code, three [23,12] Golay codes and two [15,11] Hamming codes are employed for each frame. The codes possessing more redundancy (i.e., the Golay codes) are used on the most sensitive voice bits while the codes with less redundancy (i.e., the Hamming codes) are used on less sensitive voice bits and the least sensitive voice bits are not protected with any code.

The data rate may be varied by changing either the number of voice bits or the number of FEC bits. There is a gradual effect on performance as the data rate is changed. Changes in the number of voice bits may be accommodated by reallocating the number of bits used to quantize the model parameters. In the event of a significantly higher data rate, where a corresponding increase in the number of bits used for vector quantization of the magnitude parameters would result in excessive complexity, scalar quantization, or a hierarchical approach that combines vector quantization as featured in the described embodiment with an error quantizer that quantizes the difference between the unquantized spectral magnitudes and the reconstructed result from vector quantization, may be used. An error quantizer using scalar quantization has been implemented in the context of a dual-rate system. The error quantizer reduces quantization distortion and increases perceived quality while adding only minimal complexity.

Referring to FIG. 3, the encoder first performs speech analysis 200. The first step in speech analysis is filterbank processing on each subframe followed by estimation of the MBE model parameters for each subframe. This involves dividing the input signal into overlapping subframes using an analysis window. For each 20 ms subframe, a MBE subframe parameter estimator estimates a set of model parameters that include a fundamental frequency (inverse of the pitch period), a set of voiced/unvoiced (V/UV) metrics and a set of spectral magnitudes. These parameters are generated using AMBE techniques. The speech parameters fully describe the speech signal and are passed to the encoder's quantization 210 block for further processing. Speech analysis techniques for AMBE® speech coders are described generally in U.S. Application No. 08/222,119, filed Apr. 4, 1994 and entitled "ESTIMATION OF EXCITATION PARAMETERS"; U.S. Application No. 08/392,188, filed Feb. 22, 1995 and entitled "SPECTRAL REPRESENTATIONS FOR MULTI-BAND EXCITATION SPEECH CODERS"; and U.S. Application No. 08/392,099, filed Feb. 22, 1995 and entitled "SYNTHESIS OF SPEECH USING REGENERATED PHASE INFORMATION", all of which are incorporated by reference.

Figure 5:
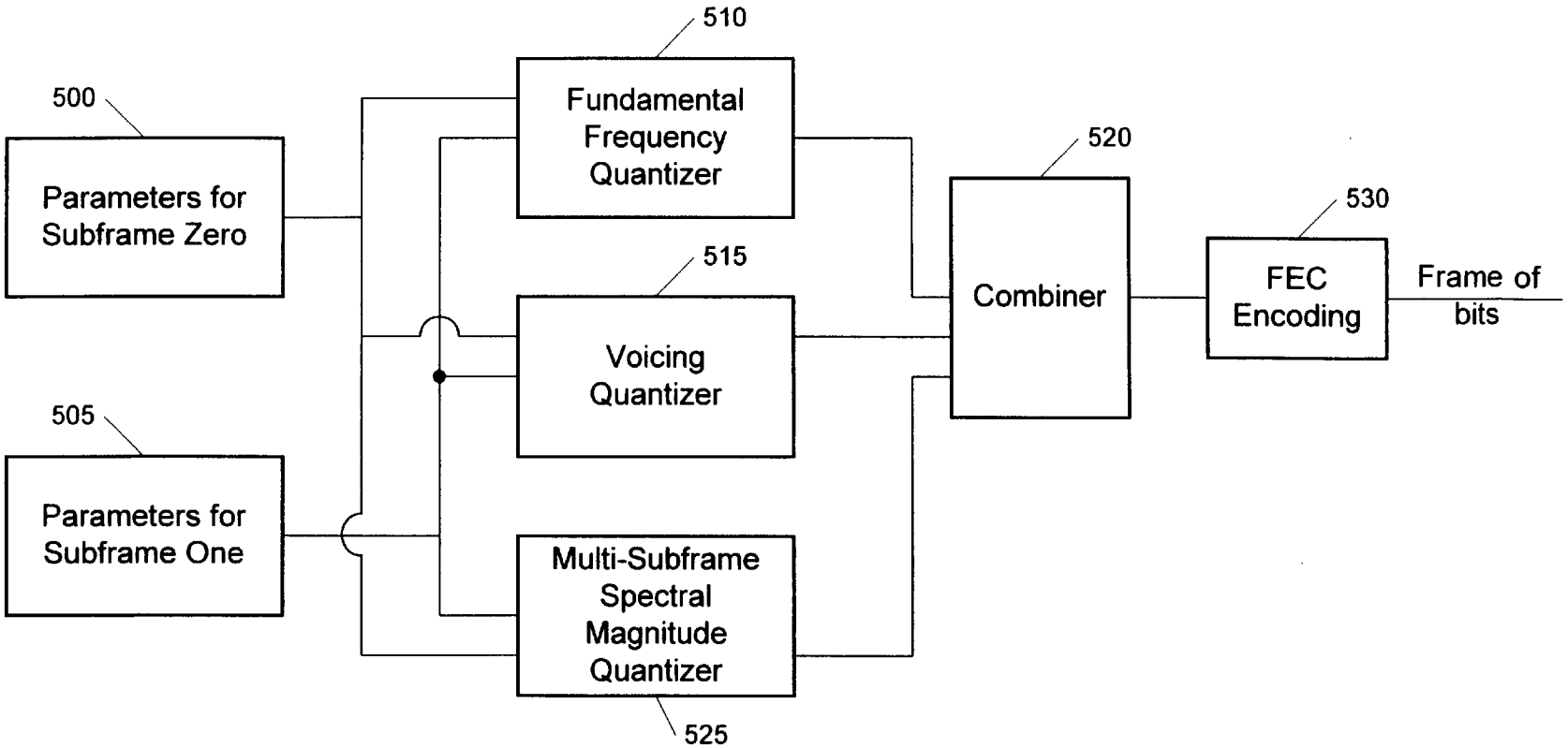
FIG. 5 is a general block diagram of components of the encoder of FIG. 3.

Referring to FIG. 5, once the subframe model parameters 500 and 505 are estimated for the two subframes of a frame, a fundamental frequency quantizer 510 receives the estimated fundamental frequency parameters from both subframes, quantizes these parameters, and produces a set of bits encoding the fundamental frequencies for both subframes. A voicing quantizer 515 receives estimated voicing metrics for both subframes, and then quantizes these parameters into a set of encoded bits representing the voicing state within the frame. The encoded fundamental frequency bits and voicing bits are fed to a combiner 520 along with encoded spectral bits from a multi-subframe spectral magnitude quantizer 525. FEC encoding 530 is applied to the output of the combiner 520 and the resulting frame of bits 535 is suitable for transmission or storage.

Figure 6:
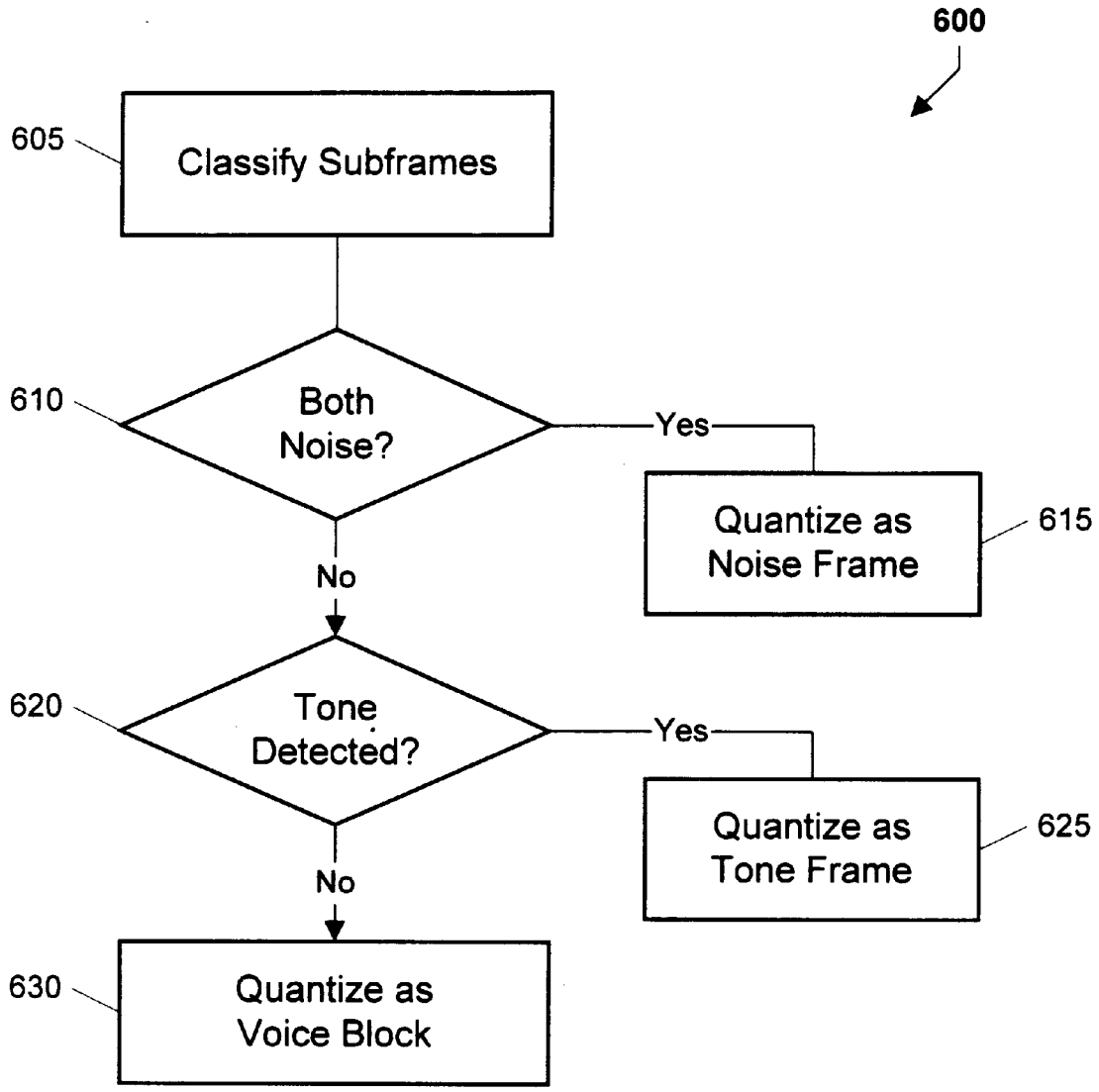
FIG. 6 is a flowchart of voice and tone detection functions of the encoder.

As shown in FIG. 6, the encoder may incorporate an adaptive Voice Activity Detector (VAD) that classifies each subframe as either voice, background noise or a tone according to a procedure 600. The VAD algorithm uses local information to distinguish voice subframes from background noise (step 605). If both subframes within a frame are classified as noise (step 610), then the encoder quantizes the background noise that is present as a special Noise frame (step 615). When a frame is a noise frame, the system may choose not to transmit the frame to the decoder and the decoder will use previously received noise data in place of the missing frame. This voice activated transmission technique increases performance of the system by only requiring voice frames and occasional noise frames to be transmitted.

The encoder also may feature tone detection and transmission in support of DTMF, call progress (e.g., dial, busy and ringback) and single tones. The encoder checks each subframe to determine whether the current subframe contains a valid tone signal. If a tone is detected in a subframe (step 620), then the encoder quantizes the detected tone parameters (magnitude and index) in a special Tone frame as shown in Table 1 (step 625) and applies FEC coding prior to transmitting the frame to the decoder for subsequent synthesis. If a tone is not detected, then a standard voice frame is quantized as described below (step 630).

TABLE 1

Tone Frame Bit Representation

| b [ ] element # | Value |
|---|---|
| 0–3 | 15 |
| 4–9 | 16 |
| 10–12 | 3 MSB's of Amplitude |
| 13–14 | 0 |
| 15–19 | 5 LSB's of Amplitude |
| 20–27 | Detected Tone Index |
| 28–35 | Detected Tone Index |

TABLE 1-continued

Tone Frame Bit Representation

| b [ ] element # | Value |
|---|---|
| 36–43 | Detected Tone Index |
| . | . |
| . | . |
| 84–91 | Detected Tone Index |
| 92–99 | Detected Tone Index |
| 100–102 | 0 |

The vocoder includes VAD and Tone detection to classify each frame as either a standard Voice frame, a special Tone frame, or a special Noise frame. In the event that a frame is not classified as a special Tone frame, then the voice or noise information (as determined by the VAD) is quantized for the pair of subframes. The 156 available bits are allocated over the model parameters and FEC coding as shown in Table 2. After reserving bits for the excitation parameters (fundamental frequency and voicing metrics) and FEC coding, there are 85 bits available for the spectral magnitudes.

TABLE 2

Bit Allocation for Voice or Noise Frames

| Vocoder Parameter | Bits |
|---|---|
| Fund. Freq. | 10 |
| Voicing Metrics | 8 |
| Gain | 5 + 5 = 10 |
| PRBA Vector | 8 + 6 + 7 + 8 + 6 = 35 |
| HOC Vector | 4*(7 + 3) = 40 |
| FEC Coding | 12 + 3*11 + 2*4 = 53 |
| Total | 156 |

The multi-subframe quantizer quantizes the spectral magnitudes. The quantizer combines logarithmic companding, spectral prediction, discrete cosine transforms (DCTs) and vector and scalar quantization to achieve high efficiency, measured in terms of fidelity per bit, with reasonable complexity. The quantizer can be viewed as a two-dimensional (time-frequency) predictive transform coder. The quantizer jointly encodes the spectral magnitudes from all of the subframes (typically two) of the current frame. As a first step, the quantizer computes the logarithm of the estimated spectral magnitudes for each subframe to convert them into a domain that is better for quantization. The quantizer then may apply a low-frequency boost to the log spectral magnitudes to compensate for missing low-frequency energy which may have been removed through filtering in the telephone system or elsewhere. The magnitude quantizer then computes predicted spectral parameters for each subframe using quantized and reconstructed log spectral magnitudes from the last subframe of the prior frame. These prior magnitudes are linearly interpolated and resampled to compensate for the possible difference between the number of magnitudes in the prior subframe and the number of magnitudes in each of the subframes in the current frame. In addition to interpolation and resampling, the computation of the predicted spectral parameters removes the mean value of the parameters and applies a multiplicative "leakage factor" that is less than one (e.g., 0.8) to ensure that any error in previous magnitudes caused by bit errors decays away over a few frames.

Figure 7:
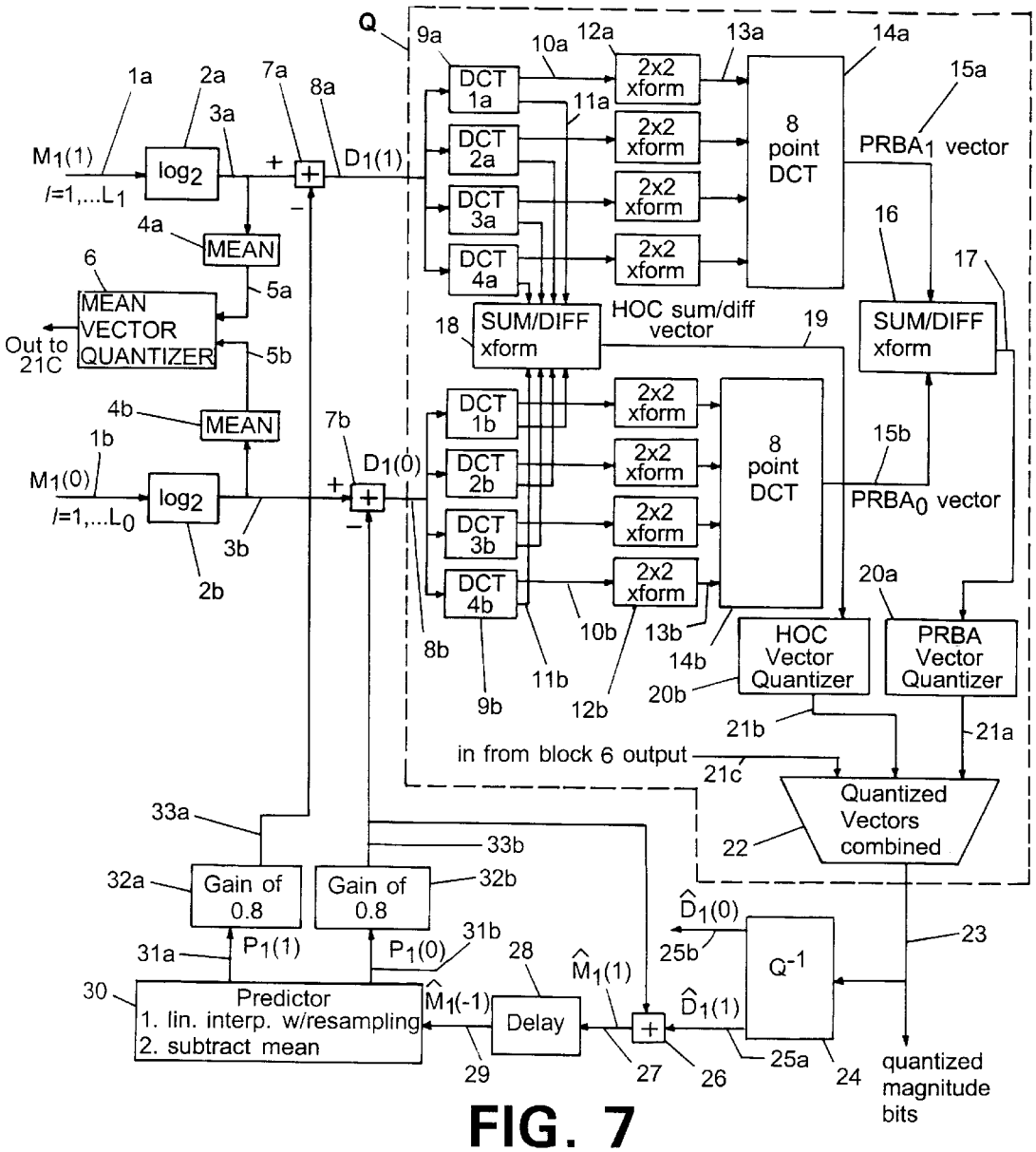
FIG. 7 is a block diagram of a multi-subframe magnitude quantizer of the encoder of FIG. 5.

FIG. 7 illustrates a dual-frame magnitude quantizer that receives inputs 1*a* and 1*b* from the MBE parameter estimators for two consecutive subframes. Input 1*a* represents the spectral magnitudes for odd numbered subframes and is given an index of 1. The number of magnitudes for subframe number 1 is designated by $L_1$. Input 1*b* represents the spectral magnitudes for the even numbered subframes and is given the index of 0. The number of magnitudes for subframe number 0 is a variable, designated by $L_o$.

Input la passes through a logarithmic compander 2*a,* which performs a log base 2 operation on each of the $L_1$ magnitudes contained in input la and generates another vector with $L_1$ elements in the following manner:

$$y[i]=\log_2(x[i]) \text{ for } i=1, 2, \ldots, L_1,$$

where y[i] represents signal 3*a*. Compander 2*b* performs the log base 2 operation on each of the $L_0$ magnitudes contained in input 1*b* and generates another vector with $L_0$ elements in a similar manner:

$$y[i]=\log_2(x[i]) \text{ for } i=1, 2, \ldots L_0,$$

where y[i] represents signal 3*b*.

Mean calculators 4*a* and 4*b* following the companders 2*a* and 2*b* calculate means 5*a* and 5*b* for each subframe. The mean, or gain value, represents the average speech level for the subframe. Within each frame, two gain values 5*a,* 5*b* are determined by computing the mean of the log spectral magnitudes for each of the two subframes and then adding an offset dependent on the number of harmonics within the subframe.

The mean computation of the log spectral magnitudes 3*a* is calculated as:

$$y = \frac{1}{L_1}\sum_{i=1}^{L_1} x[i] + 0.5\log_2(L_1)$$

where the output, y, represents the mean signal 5*a*.

The mean computation 4*b* of the log spectral magnitudes 3*b* is calculated in a similar manner:

$$y = \frac{1}{L_0}\sum_{i=1}^{L_0} x[i] + 0.5\log_2(L_0)$$

where the output, y, represents the mean signal 5*b*.

Figure 8:
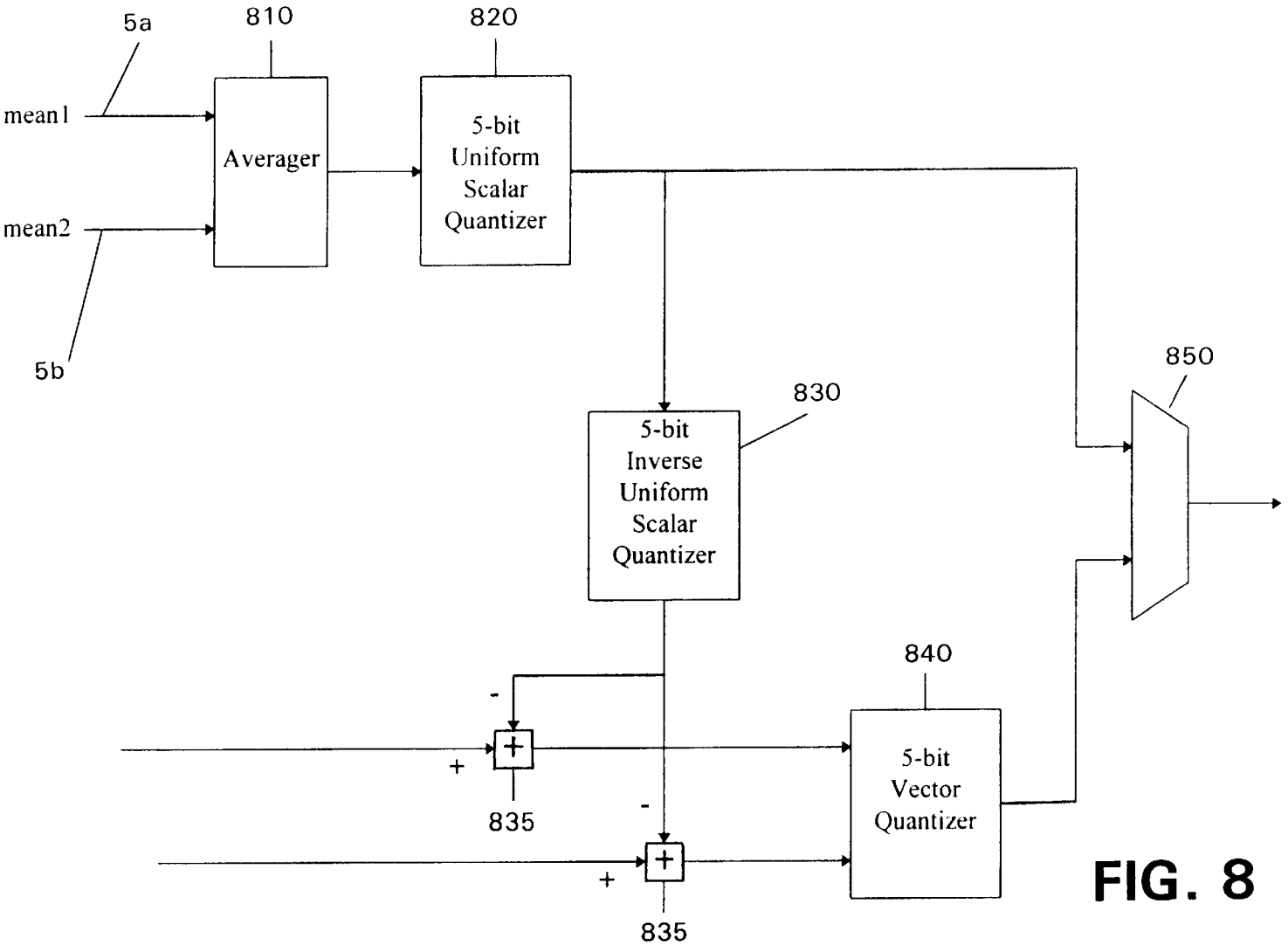
FIG. 8 is a block diagram of a mean vector quantizer of the magnitude quantizer of FIG. 7.

The mean signals 5*a* and 5*b* are quantized by a quantizer 6 that is further illustrated in FIG. 8, where the mean signals 5*a* and 5*b* are referenced, respectively, as mean1 and mean2. First, an averager 810 averages the mean signals. The output of the averager is 0.5*(mean1+mean2). The average is then quantized by a five-bit uniform scalar quantizer 820. The output of the quantizer 820 forms the first five bits of the output of the quantizer 6. The quantizer output bits are then inverse-quantized by a five-bit uniform inverse scalar quantizer 830. Subtracters 835 then subtract the output of the inverse quantizer 830 from the input values mean1 and mean2 to produce inputs to a five-bit vector quantizer 840. The two inputs constitute a two-dimensional vector (z1 and z2) to be quantized. The vector is compared to each two-dimensional vector consisting of x1(n) and x2(n)) in the table contained in Table A ("Gain VQ Codebook (5-bit)"). The comparison is based on the square distance, e, which is calculated as follows:

$$e(n)=[x1(n)-z]^2+[x2(n)-z2]^2,$$

for n=0, 1, . . . 31. The vector from Table A that minimizes the square distance, e, is selected to produce the last five bits of the output of block 6. The five bits from the output of the vector quantizer 840 are combined with the five bits from the output of the five-bit uniform scalar quantizer 820 by a combiner 850. The output of the combiner 850 is ten bits constituting the output of block 6 which is labeled 21*c* and is used as an input to the combiner 22 in FIG. 7.

Referring further to the main signal path of the quantizer, the log companded input signals 3*a* and 3*b* pass through combiners 7*a* and 7*b* that subtract predictor values 33*a* and 33*b* from the feedback portion of the quantizer to produce a $D_1(l)$ signal 8*a* and a $D_1(0)$ signal 8*b*.

Next, the signals 8*a* and 8*b* are divided into four frequency blocks using the look-up table in Table O. The table provides the number of magnitudes to be allocated to each of the four frequency blocks based on the total number of magnitudes for the subframe being divided. Since the number of magnitudes contained in any subframe ranges from a minimum of 9 to a maximum of 56, the table contains values for this same range. The length of each frequency block is adjusted such that they are approximately in a ratio of 0.2:0.225:0.275:0.3 to each other and the sum of the lengths equals the number of spectral magnitudes in the current subframe.

Each frequency block is then passed through a discrete cosine transform (DCT) 9*a* or 9*b* to efficiently decorrelate the data within each frequency block. The first two DCT coefficients 10*a* or 10*b* from each frequency block are then separated out and passed through a 2×2 rotation operation 12*a* or 12*b* to produce transformed coefficients 13*a* or 13*b*. An eight-point DCT 14*a* or 14*b* is then performed on the transformed coefficients 13*a* or 13*b* to produce a prediction residual block average (PRBA) vector 15*a* or 15*b*. The remaining DCT coefficients 11*a* and 11*b* from each frequency block form a set of four variable length higher order coefficient (HOC) vectors.

As described above, following the frequency division, each block is processed by the discrete cosine transform blocks 9*a* or 9*b*. The DCT blocks use the number of input bins, W, and the values for each of the bins, x(0), x(1), . . . , x(W-1) in the following manner:

The values y(0) and y(1) (identified as 10*a*) are separated from the other outputs y(2) through y(W-1) (identified as 11*a*).

$$y(k) = \frac{1}{W}\sum_{i=0}^{W-1} x(i)\cos\frac{(2i+1)k\pi}{2W} \text{ for } 0 \le k \le (W-1)$$

A 2×2 rotation operation 12*a* and 12*b* is then performed to transform the 2-element input vector 10*a* and 10*b,* (x(0), x(1)), into a 2-element output vector 13*a* and 13*b,* (y(0),y (1)) by the following rotation procedure:

$$y(0)=x(0)+\text{sqrt}(2)^*\times(1), \text{ and}$$

$$y(1)=x(0)-\text{sqrt}(2)^*\, x(1).$$

An 8-point DCT is then performed on the four, 2-element vectors, (x(0),x(1), . . . ,x(7) ) from 13*a* or 13*b* according to the following equation:

$$y(k) = \frac{1}{8}\sum_{i=0}^{7} x(i)\cos\frac{(2i+1)k\pi}{16} \text{ for } 0 \le k \le 7$$

The output, y(k), is an 8-element PRBA vector 15*a* or 15*b*.

Once the prediction and DCT transformation of the individual subframe magnitudes have been completed, both PRBA vectors are quantized. The two eight-element vectors are first combined using a sum-difference transformation 16 into a sum vector and a difference vector. In particular, sum/difference operation 16 is performed on the two 8-element PRBA vectors 15*a* and 15*b*, which are represented by x and y respectively, to produce a 16-element vector 17, represented by z, in the following manner:

$$x(i)=x(i)+y(i), \text{ and}$$

$$z(8+i)=x(i)-y(i),$$

for i =0, 1, ... , 7.

These vectors are then quantized using a split vector quantizer 20*a* where 8, 6, and 7 bits are used for elements 1–2, 3–4, and 5–7 of the sum vector, respectively, and 8 and 6 bits are used for elements 1–3 and 4–7 of the difference vector, respectively. Element 0 of each vector is ignored since it is functionally equivalent to the gain value that is quantized separately.

The quantization of the PRBA sum and difference vectors 17 is performed by the PRBA split-vector quantizer 20*a* to produce a quantized vector 21*a*. The two elements z(1) and z(2) constitute a two-dimensional vector to be quantized. The vector is compared to each two-dimensional vector (consisting of x1(n) and x2(n) in the table contained in Table B ("PRBA Sum[1,2] VQ Codebook (8-bit)"). The comparison is based on the square distance, e, which is calculated as follows:

$$e(n)=[x1\ (n)-Z(1)]^2+[x2(n)-z(2)]^2,$$

for n=0,1, ..., 255. The vector from Table B that minimizes the square distance, e, is selected to produce the first 8 bits of the output vector 21*a*.

Next, the two elements z(3) and z(4) constitute a two-dimensional vector to be quantized. The vector is compared to each two-dimensional vector (consisting of x1(n)) and x2(n) in the table contained in Table C ("PRBA Sum[3,4] VQ Codebook (6-bit)"). The comparison is based on the square distance, e, which is calculated as follows:

$$e(n)=[x1(n)-z(3)]^2+[x2\ (n)-z(4)]^2,$$

for n=0,1, . . . , 63. The vector from Table C which minimizes the square distance, e, is selected to produce the next 6 bits of the output vector 21*a*.

Next, the three elements z(5), z(6) and z(7) constitute a three-dimensional vector to be quantized. The vector is compared to each three-dimensional vector (consisting of x1(n), x2(n) and x3(n) in the table contained in Appendix D ("PRBA Sum[5,7] VQ Codebook (7bit)"). The comparison is based on the square distance, e, which is calculated as follows:

$$e(n)=[x1(n)-z(5)]^2+[x2\ (n)-z(6)]^2+[x3\ (n)-z\ (7)]^2$$

for n =0, 1, . . . , 127. The vector from Table D which minimizes the square distance, e, is selected to produce the next 7 bits of the output vector 21*a*.

Next, the three elements z(9), z(10) and z(11) constitute a three-dimensional vector to be quantized. The vector is compared to each three-dimensional vector (consisting of x1(n), x2(n) and x3(n) in the table contained in Appendix E ("PRBA Dif[1,3] VQ Codebook (8-bit)"). The comparison is based on the square distance, e, which is calculated as follows:

$$e(n)=[x1(n)-z(9)]^2+[x2(n)-z(10)]^2+[x3(n)-z(11)]^2,$$

for n=0,1, . . . , 255. The vector from Table E which minimizes the square distance, e, is selected to produce the next 8 bits of the output vector 21*a*.

Finally, the four elements z(12), z(13), z(14) and z(15) constitute a four-dimensional vector to be quantized. The vector is compared to each four-dimensional vector (consisting of x1(n), x2(n), x3(n) and x4(n) in the table contained in Table F ("PRBA Dif[4,7] VQ Codebook (6-bit) "). The comparison is based on the square distance, e, which is calculated as:

$$e(n) = [x1(n) - z(12)]^2 + [x2(n) - z(13)]^2 + [x3(n) - z(14)]^2 + [x4(n) - z(15)]^2$$

for n=0,1, . . . , 63. The vector from Table F which minimizes the square distance, e, is selected to produce the last 6 bits of the output vector 21*a*.

The HOC vectors are quantized similarly to the PRBA vectors. First, for each of the four frequency blocks, the corresponding pair of HOC vectors from the two subframes are combined using a sum-difference transformation 18 that produces a sum and difference vector 19 for each frequency block.

The sum/difference operation is performed separately for each frequency block on the two HOC vectors 11*a* and 11*b*, referred to as x and y respectively, to produce a vector, $Z_m$:

$$J = \max(B_{m0}, B_{m1}) - 2$$

$$K = \min(B_{m0}, B_{m1}) - 2$$

$$z_m(i) = 0.5[x(i) + y(i)] \text{ for } 1 \le i \le K$$

$$z_m(i) = \begin{cases} y(i) & \text{if } L_0 > L_1 \\ x(i) & \text{otherwise} \end{cases} \text{ for } K < i \le J$$

$$z_m(J + i) = 0.5[x(i) - y(i)] \text{ for } 0 \le i < K.$$

where $B_{m0}$ and $B_{m1}$ are the lengths of the mth frequency block for, respectively, subframes zero and one, as set forth in Table O, and z is determined for each frequency block (i.e., m equals 0 to 3). The J+K element sum and difference vectors $z_m$ are combined for all four frequency blocks (m equals 0 to 3) to form the HOC sum/difference vector 19.

Due to the variable size of each HOC vector, the sum and difference vectors also have variable, and possibly different, lengths. This is handled in the vector quantization step by ignoring any elements beyond the first four elements of each vector. The remaining elements are vector quantized using seven bits for the sum vector and three bits for the difference vector. After vector quantization is performed, the original sum-difference transformation is reversed on the quantized sum and difference vectors. Since this process is applied to all four frequency blocks a total of forty (4* (7+3)) bits are used to vector quantize the HOC vectors corresponding to both subframes.

The quantization of the HOC sum and difference vectors 19 is performed separately on all four frequency blocks by the HOC split-vector quantizer 20*b*. First, the vector $z_m$ representing the mth frequency block is separated and compared against each candidate vector in the corresponding sum and difference codebooks contained in the Appendices. A codebook is identified based on the frequency block to which it corresponds and whether it is a sum or difference code. Thus, the "HOC Sum0 VQ Codebook (7-bit)" of Table G represents the sum codebook for frequency block 0. The other codebooks are Table H ("HOC Dif0 VQ Codebook (3-bit)"), Table I ("HOC Sum1 VQ Codebook (7-bit)"), Table J ("HOC Dif1 VQ Codebook (3-bit)"), Table K ("HOC Sum2 VQ Codebook (7-bit)"), Table L ("HOC Dif2 VQ Codebook (3-bit)"), Table M ("HOC Sum2 VQ Codebook (7-bit)"), and Table N ("HOC Dif3 VQ Codebook (3-bit)"). The comparison of the vector $z_m$ for each frequency block with each candidate vector from the corresponding sum codebooks is based upon the square distance, $e1_n$ for each candidate sum vector (consisting of x1(n), x2(n), x3(n) and x4(n)) which is calculated as:

$$e1_n = \sum_{i=1}^{\min(J,4)} [z(i) - xi(n)]^2 \quad 0 \le n < 128,$$

and the square distance $e2_m$ for each candidate difference vector (consisting of x1(n), x2(n), x3(n) and x4(n)), which is calculated as:

$$e2_m = \sum_{i=1}^{\min(K,4)} [z(J+i) - xi(m)]^2 \quad 0 \le m < 8,$$

where J and K are computed as described above.

The index n of the candidate sum vector from the corresponding sum notebook which minimizes the square distance $e1_n$ is represented with seven bits and the index m of the candidate difference vector which minimizes the square distance $e2_m$ is represented with three bits. These ten bits are combined from all four frequency blocks to form the 40 HOC output bits 21*b*.

Block 22 multiplexes the quantized PRBA vectors 21*a*, the quantized mean 21*b*, and the quantized mean bits 21*c* to produce output bits 23. These bits 23 are the final output bits of the dual-subframe magnitude quantizer and are also supplied to the feedback portion of the quantizer.

Block 24 of the feedback portion of the dual-subframe quantizer represents the inverse of the functions performed in the superblock labeled Q in the drawing. Block 24 produces estimated values 25*a* and 25*b* of $D_1(1)$ and $D_1(0)$ (8*a* and 8*b*) in response to the quantized bits 23. These estimates would equal $D_1(1)$ and $D_1(0)$ in the absence of quantization error in the superblock labeled Q.

Block 26 adds a scaled prediction value 33*a*, which equals 0.8* $P_1(l)$, to the estimate of $D_1(l)$ 25*a* to produce an estimate $M_1(1)$ 27. Block 28 time-delays the estimate $M_1(1)$ 27 by one frame (40 ms) to produce the estimate $M_1(-1)$ 29.

A predictor block 30 then interpolates the estimated magnitudes and resamples them to produce $L_1$ estimated magnitudes after which the mean value of the estimated magnitudes is subtracted from each of the $L_1$ estimated magnitudes to produce the $P_1(1)$ output 31*a*. Next, the input estimated magnitudes are interpolated and resampled to produce $L_0$ estimated magnitudes after which the mean value of the estimated magnitudes is subtracted from each of the $L_0$ estimated magnitudes to produce the $P_1(0)$ output 31*b*.

Block 32*a* multiplies each magnitude in $P_1(l)$ 31*a* by 0.8 to produce the output vector 33*a* which is used in the feedback element combiner block 7*a*. Likewise, block 32*b* multiplies each magnitude in $P_1(1)$ 31*b* by 0.8 to produce the output vector 33*b* which is used in the feedback element combiner block 7*b*. The output of this process is the quantized magnitude output bits 23, which form the encoder spectral bits for the current frame.

Experimentation has shown that the PRBA and HOC sum vectors are typically more sensitive to bit errors than the corresponding difference vectors. In addition, the PRBA sum vector is typically more sensitive than the HOC sum vector. These relative sensitivities are employed in a prioritization scheme which orders the bits according to their relative sensitivity to bit errors. Generally, the most significant fundamental bits and average gain bits are followed by the PRBA sum bits and the HOC sum bits, and these are followed by the PRBA difference bits and HOC difference bits, followed by any remaining bits. Prioritization is followed by FEC encoding and interleaving to form the encoder output bit stream. FEC encoding may employ block codes or convolution codes. However, in the described embodiment, one [24,12] extended Golay code protects the 12 highest priority (i.e., the most sensitive) bits, three [23,12] Golay codes protect the 36 next highest priority bits and two [14,11] Hamming codes protect the 22 next highest priority bits. The remaining 33 bits per frame are unprotected.

The corresponding decoder is designed to reproduce high quality speech from the encoded bit stream after it is transmitted and received across the channel. The decoder first deinterleaves each frame and performs error correction decoding to correct and/or detect certain likely bit error patterns. To achieve adequate performance over the mobile communications channel, all error correction codes are typically decoded up to their full error correction capability. Next, the FEC decoded bits are used by the decoder to reassemble the quantization bits for the frame from which the model parameters representing the two subframes within the frame are reconstructed.

The AMBE® decoder uses the reconstructed log spectral magnitudes to synthesize a set of phases which are used by the voiced synthesizer to produce natural sounding speech. The use of synthesized phase information significantly lowers the transmitted data rate, relative to a system which directly transmits this information or its equivalent between the encoder and decoder. The decoder then applies spectral enhancement to the reconstructed spectral magnitudes in order to improve the perceived quality of the speech signal. The decoder further checks for bit errors and smooths the reconstructed parameters if the local estimated channel conditions indicate the presence of possible uncorrectable bit errors. The enhanced and smoothed model parameters (fundamental frequency, V/UV decisions, spectral magnitudes and synthesized phases) are used in speech synthesis. In general, the decoder performs the procedures illustrated in FIGS. 5 and 7, but in reverse.

The reconstructed parameters form the input to the decoder's speech synthesis algorithm which interpolates successive frames of model parameters into smooth segments of speech. The synthesis algorithm uses a set of harmonic oscillators (or an FFT equivalent at high frequencies) to synthesize the voiced speech. This is added to the output of a weighted overlap-add algorithm to synthesize the unvoiced speech. The sums form the synthesized speech signal which is output to a D-to-A converter for playback over a speaker. While this synthesized speech signal may not be close to the original on a sample-by-sample basis, it is perceived as the same by a human listener.

Other embodiments are within the scope of the following claims.

Table of Gain VQ Codebook (5 Bit) Values

| n | x1(n) | x2(n) |
|---|---|---|
| 0 | −6696 | 6699 |
| 1 | −5724 | 5641 |
| 2 | −4860 | 4854 |
| 3 | −3861 | 3824 |
| 4 | −3132 | 3091 |
| 5 | −2538 | 2630 |
| 6 | −2052 | 2088 |
| 7 | −1890 | 1491 |
| 8 | −1269 | 1627 |
| 9 | −1350 | 1003 |
| 10 | −756 | 1111 |
| 11 | −864 | 514 |
| 12 | −324 | 623 |
| 13 | −486 | 162 |
| 14 | −297 | −109 |
| 15 | 54 | 379 |
| 16 | 21 | −49 |
| 17 | 326 | 122 |
| 18 | 21 | −441 |
| 19 | 522 | −196 |
| 20 | 348 | −686 |
| 21 | 826 | −466 |
| 22 | 630 | −1005 |
| 23 | 1000 | −1323 |
| 24 | 1174 | −809 |
| 25 | 1631 | −1274 |
| 26 | 1479 | −1789 |
| 27 | 2088 | −1960 |
| 28 | 2566 | −2524 |
| 29 | 3132 | −3185 |
| 30 | 3958 | −3994 |
| 31 | 5546 | −5978 |

Table of PRBA Sum[1, 2] VQ Codebook (8 Bit) Values

| n | x1(n) | x2(n) |
|---|---|---|
| 0 | −2022 | −1333 |
| 1 | −1734 | −992 |
| 2 | −2757 | −664 |
| 3 | −2265 | −953 |
| 4 | −1609 | −1812 |
| 5 | −1379 | −1242 |
| 6 | −1412 | −815 |
| 7 | −1110 | −894 |
| 8 | −2219 | −467 |
| 9 | −1780 | −612 |
| 10 | −1931 | −185 |
| 11 | −1570 | −270 |
| 12 | −1484 | −579 |
| 13 | −1287 | −487 |
| 14 | −1327 | −192 |
| 15 | −1123 | −336 |
| 16 | −857 | −791 |
| 17 | −741 | −1105 |
| 18 | −1097 | −615 |
| 19 | −841 | −528 |
| 20 | −641 | −1902 |
| 21 | −554 | −820 |
| 22 | −693 | −623 |
| 23 | −470 | −557 |
| 24 | −939 | −367 |
| 25 | −816 | −236 |
| 26 | −1051 | −140 |
| 27 | −680 | −184 |
| 28 | −657 | −433 |
| 29 | −449 | −418 |
| 30 | −534 | −286 |
| 31 | −529 | −67 |
| 32 | −2597 | 0 |

-continued

Table of PRBA Sum[1, 2] VQ Codebook (8 Bit) Values

| n | x1(n) | x2(n) |
|---|---|---|
| 33 | −2243 | 0 |
| 34 | −3072 | 11 |
| 35 | −1902 | 178 |
| 36 | −1451 | 46 |
| 37 | −1305 | 258 |
| 38 | −1804 | 506 |
| 39 | −1561 | 460 |
| 40 | −3194 | 632 |
| 41 | −2085 | 678 |
| 42 | −4144 | 736 |
| 43 | −2633 | 920 |
| 44 | −1634 | 908 |
| 45 | −1146 | 592 |
| 46 | −1670 | 1460 |
| 47 | −1098 | 1075 |
| 48 | −1056 | 70 |
| 49 | −864 | −48 |
| 50 | −972 | 296 |
| 51 | −841 | 159 |
| 52 | −672 | −7 |
| 53 | −534 | 112 |
| 54 | −375 | 242 |
| 55 | −411 | 201 |
| 56 | −921 | 646 |
| 57 | −839 | 444 |
| 58 | −700 | 1442 |
| 59 | −698 | 723 |
| 60 | −654 | 462 |
| 61 | −482 | 361 |
| 62 | −459 | 801 |
| 63 | −429 | 575 |
| 64 | −376 | −1320 |
| 65 | −280 | −950 |
| 66 | −372 | −695 |
| 67 | −234 | −520 |
| 68 | −198 | −715 |
| 69 | −63 | −945 |
| 70 | −92 | −455 |
| 71 | −37 | −625 |
| 72 | −403 | −195 |
| 73 | −327 | −350 |
| 74 | −395 | −55 |
| 75 | −280 | −180 |
| 76 | −195 | −335 |
| 77 | −90 | −310 |
| 78 | −146 | −205 |
| 79 | −79 | −115 |
| 80 | 36 | −1195 |
| 81 | 64 | −1659 |
| 82 | 46 | −441 |
| 83 | 147 | −391 |
| 84 | 161 | −744 |
| 85 | 238 | −936 |
| 86 | 175 | −552 |
| 87 | 292 | −502 |
| 88 | 10 | −304 |
| 89 | 91 | −243 |
| 90 | 0 | −199 |
| 91 | 24 | −113 |
| 92 | 186 | −292 |
| 93 | 194 | −181 |
| 94 | 119 | −131 |
| 95 | 279 | −125 |
| 96 | −234 | 0 |
| 97 | −131 | 0 |
| 98 | −347 | 86 |
| 99 | −233 | 172 |
| 100 | −113 | 86 |
| 101 | −6 | 0 |
| 102 | −107 | 208 |
| 103 | −6 | 93 |
| 104 | −308 | 373 |
| 105 | −168 | 503 |
| 106 | −378 | 1056 |
| 107 | −257 | 769 |

-continued

Table of PRBA Sum[1, 2] VQ Codebook (8 Bit) Values

| n | x1(n) | x2(n) |
|---|---|---|
| 108 | −119 | 345 |
| 109 | −92 | 790 |
| 110 | −87 | 1085 |
| 111 | −56 | 1789 |
| 112 | 99 | −25 |
| 113 | 188 | −40 |
| 114 | 60 | 185 |
| 115 | 91 | 75 |
| 116 | 188 | 45 |
| 117 | 276 | 85 |
| 118 | 194 | 175 |
| 119 | 289 | 230 |
| 120 | 0 | 275 |
| 121 | 136 | 335 |
| 122 | 10 | 645 |
| 123 | 19 | 450 |
| 124 | 216 | 475 |
| 125 | 261 | 340 |
| 126 | 163 | 800 |
| 127 | 292 | 1220 |
| 128 | 349 | −677 |
| 129 | 438 | −968 |
| 130 | 302 | −658 |
| 131 | 401 | −303 |
| 132 | 495 | −1386 |
| 133 | 578 | −743 |
| 134 | 455 | −517 |
| 135 | 512 | −402 |
| 136 | 294 | −242 |
| 137 | 368 | −171 |
| 138 | 310 | −11 |
| 139 | 379 | −83 |
| 140 | 483 | −165 |
| 141 | 509 | −281 |
| 142 | 455 | −66 |
| 143 | 536 | −50 |
| 144 | 676 | −1071 |
| 145 | 770 | −843 |
| 146 | 842 | −434 |
| 147 | 646 | −575 |
| 148 | 823 | −630 |
| 149 | 934 | −989 |
| 150 | 774 | −438 |
| 151 | 951 | −418 |
| 152 | 592 | −186 |
| 153 | 600 | −312 |
| 154 | 646 | −79 |
| 155 | 695 | −170 |
| 156 | 734 | −288 |
| 157 | 958 | −268 |
| 158 | 936 | −87 |
| 159 | 837 | −217 |
| 160 | 364 | 112 |
| 161 | 418 | 25 |
| 162 | 413 | 206 |
| 163 | 465 | 125 |
| 164 | 524 | 56 |
| 165 | 566 | 162 |
| 166 | 498 | 293 |
| 167 | 583 | 268 |
| 168 | 361 | 481 |
| 169 | 399 | 343 |
| 170 | 304 | 643 |
| 171 | 407 | 912 |
| 172 | 513 | 431 |
| 173 | 527 | 612 |
| 174 | 554 | 1618 |
| 175 | 606 | 750 |
| 176 | 621 | 49 |
| 177 | 718 | 0 |
| 178 | 674 | 135 |
| 179 | 688 | 238 |
| 180 | 748 | 90 |
| 181 | 879 | 36 |
| 182 | 790 | 198 |

-continued

Table of PRBA Sum[1, 2] VQ Codebook (8 Bit) Values

| n | x1(n) | x2(n) |
|---|---|---|
| 183 | 933 | 189 |
| 184 | 647 | 378 |
| 185 | 795 | 405 |
| 186 | 648 | 495 |
| 187 | 714 | 1138 |
| 188 | 795 | 594 |
| 189 | 832 | 301 |
| 190 | 817 | 886 |
| 191 | 970 | 711 |
| 192 | 1014 | −1346 |
| 193 | 1226 | −870 |
| 194 | 1026 | −657 |
| 195 | 1194 | −429 |
| 196 | 1462 | −1410 |
| 197 | 1539 | −1146 |
| 198 | 1305 | −629 |
| 199 | 1460 | −752 |
| 200 | 1010 | −94 |
| 201 | 1172 | −253 |
| 202 | 1030 | 58 |
| 203 | 1174 | −53 |
| 204 | 1392 | −106 |
| 205 | 1422 | −347 |
| 206 | 1273 | 82 |
| 207 | 1581 | −24 |
| 208 | 1793 | −787 |
| 209 | 2178 | −629 |
| 210 | 1645 | −440 |
| 211 | 1872 | −468 |
| 212 | 2231 | −999 |
| 213 | 2782 | −782 |
| 214 | 2607 | −296 |
| 215 | 3491 | −639 |
| 216 | 1802 | −181 |
| 217 | 2108 | −283 |
| 218 | 1828 | 171 |
| 219 | 2065 | 60 |
| 220 | 2458 | 4 |
| 221 | 3132 | −153 |
| 222 | 2765 | 46 |
| 223 | 3867 | 41 |
| 224 | 1035 | 318 |
| 225 | 1113 | 194 |
| 226 | 971 | 471 |
| 227 | 1213 | 353 |
| 228 | 1356 | 228 |
| 229 | 1484 | 339 |
| 230 | 1363 | 450 |
| 231 | 1558 | 540 |
| 232 | 1090 | 908 |
| 233 | 1142 | 589 |
| 234 | 1073 | 1248 |
| 235 | 1368 | 1137 |
| 236 | 1372 | 728 |
| 237 | 1574 | 901 |
| 238 | 1479 | 1956 |
| 239 | 1498 | 1567 |
| 240 | 1588 | 184 |
| 241 | 2092 | 460 |
| 242 | 1798 | 468 |
| 243 | 1844 | 737 |
| 244 | 2433 | 353 |
| 245 | 3030 | 330 |
| 246 | 2224 | 714 |
| 247 | 3557 | 553 |
| 248 | 1728 | 1221 |
| 249 | 2053 | 975 |
| 250 | 2038 | 1544 |
| 251 | 2480 | 2136 |
| 252 | 2689 | 775 |
| 253 | 3448 | 1098 |
| 254 | 2526 | 1106 |
| 255 | 3162 | 1736 |

Table of PRBA Sum[3,4] VQ Codebook (6 Bit) Values

| n | x1(n) | x2(n) | n | x1(n) | x2(n) |
|---|---|---|---|---|---|
| 0 | −1320 | −848 | 32 | 203 | −961 |
| 1 | −820 | −743 | 33 | 184 | −397 |
| 2 | −440 | −972 | 34 | 370 | −550 |
| 3 | −424 | −584 | 35 | 358 | −279 |
| 4 | −715 | −466 | 36 | 135 | −199 |
| 5 | −1155 | −335 | 37 | 135 | −5 |
| 6 | −627 | −243 | 38 | 277 | −111 |
| 7 | −402 | −183 | 39 | 444 | −92 |
| 8 | −165 | −459 | 40 | 661 | −744 |
| 9 | −385 | −378 | 41 | 593 | −355 |
| 10 | −160 | −716 | 42 | 1193 | −634 |
| 11 | 77 | −594 | 43 | 933 | −432 |
| 12 | −198 | −277 | 44 | 797 | −191 |
| 13 | −204 | −115 | 45 | 611 | −65 |
| 14 | −6 | −362 | 46 | 1125 | −130 |
| 15 | −22 | −173 | 47 | 1700 | −24 |
| 16 | −841 | −86 | 48 | 143 | 183 |
| 17 | −1178 | 206 | 49 | 288 | 262 |
| 18 | −551 | 20 | 50 | 307 | 60 |
| 19 | −414 | 209 | 51 | 478 | 153 |
| 20 | −713 | 252 | 52 | 189 | 457 |
| 21 | −770 | 665 | 53 | 78 | 967 |
| 22 | −433 | 473 | 54 | 445 | 393 |
| 23 | −361 | 818 | 55 | 386 | 693 |
| 24 | −338 | 17 | 56 | 819 | 67 |
| 25 | −148 | 49 | 57 | 681 | 266 |
| 26 | −5 | −33 | 58 | 1023 | 273 |
| 27 | −10 | 124 | 59 | 1351 | 281 |
| 28 | −195 | 234 | 60 | 708 | 551 |
| 29 | −129 | 469 | 61 | 734 | 1016 |
| 30 | 9 | 316 | 62 | 983 | 618 |
| 31 | −43 | 647 | 63 | 1751 | 723 |

Table of PRBA Sum[5, 7] VQ Codebook (8 Bit) Values

| n | x1(n) | x2(n) | x3(n) |
|---|---|---|---|
| 0 | −473 | −644 | −166 |
| 1 | −334 | −483 | −439 |
| 2 | −688 | −460 | −147 |
| 3 | −387 | −391 | −108 |
| 4 | −613 | −253 | −264 |
| 5 | −291 | −207 | −322 |
| 6 | −592 | −230 | −30 |
| 7 | −334 | −92 | −127 |
| 8 | −226 | −276 | −108 |
| 9 | −140 | −245 | −264 |
| 10 | −248 | −805 | 9 |
| 11 | −183 | −506 | −108 |
| 12 | −205 | −92 | −595 |
| 13 | −22 | −92 | −244 |
| 14 | −151 | −138 | −30 |
| 15 | −43 | −253 | −147 |
| 16 | −822 | −308 | −208 |
| 17 | −372 | −563 | 80 |
| 18 | −557 | −518 | 240 |
| 19 | −253 | −548 | 368 |
| 20 | −504 | −263 | 160 |
| 21 | −319 | −158 | 48 |
| 22 | −491 | −173 | 528 |
| 23 | −279 | −233 | 288 |
| 24 | −239 | −268 | 64 |
| 25 | −94 | −563 | 176 |
| 26 | −147 | −338 | 224 |
| 27 | −107 | −338 | 528 |
| 28 | −133 | −203 | 96 |
| 29 | −14 | −263 | 32 |
| 30 | −107 | −98 | 352 |
| 31 | −1 | −248 | 256 |
| 32 | −494 | −52 | −345 |

-continued

Table of PRBA Sum[5, 7] VQ Codebook (8 Bit) Values

| n | x1(n) | x2(n) | x3(n) |
|---|---|---|---|
| 33 | −239 | 92 | −257 |
| 34 | −485 | −72 | −32 |
| 35 | −383 | 153 | −82 |
| 36 | −375 | 194 | −407 |
| 37 | −205 | 543 | −382 |
| 38 | −536 | 379 | −57 |
| 39 | −247 | 338 | −207 |
| 40 | −171 | −72 | −220 |
| 41 | −35 | −72 | −395 |
| 42 | −188 | −11 | −32 |
| 43 | −26 | −52 | −95 |
| 44 | −94 | 71 | −207 |
| 45 | −9 | 338 | −245 |
| 46 | −154 | 153 | −70 |
| 47 | −18 | 215 | −132 |
| 48 | −709 | 78 | 78 |
| 49 | −316 | 78 | 78 |
| 50 | −462 | −57 | 234 |
| 51 | −226 | 100 | 273 |
| 52 | −259 | 325 | 117 |
| 53 | −192 | 618 | 0 |
| 54 | −507 | 213 | 312 |
| 55 | −226 | 348 | 390 |
| 56 | −68 | −57 | 78 |
| 57 | −34 | 33 | 19 |
| 58 | −192 | −57 | 156 |
| 59 | −192 | −12 | 585 |
| 60 | −113 | 123 | 117 |
| 61 | −57 | 280 | 19 |
| 62 | −12 | 348 | 263 |
| 63 | −12 | 78 | 234 |
| 64 | 60 | −383 | −304 |
| 65 | 84 | −473 | −589 |
| 66 | 12 | −495 | −153 |
| 67 | 204 | −765 | −247 |
| 68 | 108 | −135 | −209 |
| 69 | 156 | −360 | −76 |
| 70 | 60 | −180 | −38 |
| 71 | 192 | −158 | −38 |
| 72 | 204 | −248 | −456 |
| 73 | 420 | −495 | −247 |
| 74 | 408 | −293 | −57 |
| 75 | 744 | −473 | −19 |
| 76 | 480 | −225 | −475 |
| 77 | 768 | −68 | −285 |
| 78 | 276 | −225 | −228 |
| 79 | 480 | −113 | −190 |
| 80 | 0 | −403 | 88 |
| 81 | 210 | −472 | 120 |
| 82 | 100 | −633 | 408 |
| 83 | 180 | −265 | 520 |
| 84 | 50 | −104 | 120 |
| 85 | 130 | −219 | 104 |
| 86 | 110 | −81 | 296 |
| 87 | 190 | −265 | 312 |
| 88 | 270 | −242 | 88 |
| 89 | 330 | −771 | 104 |
| 90 | 430 | −403 | 232 |
| 91 | 590 | −219 | 504 |
| 92 | 350 | −104 | 24 |
| 93 | 630 | −173 | 104 |
| 94 | 220 | −58 | 136 |
| 95 | 370 | −104 | 248 |
| 96 | 67 | 63 | −238 |
| 97 | 242 | −42 | −314 |
| 98 | 80 | 105 | −86 |
| 99 | 107 | −42 | −29 |
| 100 | 175 | 126 | −542 |
| 101 | 202 | 168 | −238 |
| 102 | 107 | 336 | −29 |
| 103 | 242 | 168 | −29 |
| 104 | 458 | 168 | −29 |
| 104 | 458 | 168 | −371 |
| 105 | 458 | 252 | −162 |
| 106 | 369 | 0 | −143 |

-continued

Table of PRBA Sum[5, 7] VQ Codebook (8 Bit) Values

| n | x1(n) | x2(n) | x3(n) |
|---|---|---|---|
| 107 | 377 | 63 | −29 |
| 108 | 242 | 378 | −295 |
| 109 | 917 | 525 | −276 |
| 110 | 256 | 588 | −67 |
| 111 | 310 | 336 | 28 |
| 112 | 72 | 42 | 120 |
| 113 | 188 | 42 | 46 |
| 114 | 202 | 147 | 212 |
| 115 | 246 | 21 | 527 |
| 116 | 14 | 672 | 286 |
| 117 | 43 | 189 | 101 |
| 118 | 57 | 147 | 379 |
| 119 | 1595 | 420 | 527 |
| 120 | 391 | 105 | 138 |
| 121 | 608 | 105 | 46 |
| 122 | 391 | 126 | 342 |
| 123 | 927 | 63 | 231 |
| 124 | 585 | 273 | 175 |
| 125 | 579 | 546 | 212 |
| 126 | 289 | 378 | 286 |
| 127 | 637 | 252 | 619 |

Table of PRBA Dif[1, 3] VQ Codebook (8 Bit) Values

| n | x1(n) | x2(n) | x3(n) |
|---|---|---|---|
| 0 | −1153 | −430 | −504 |
| 1 | −1001 | −626 | −861 |
| 2 | −1240 | −846 | −252 |
| 3 | −805 | −748 | −252 |
| 4 | −1675 | −381 | −336 |
| 5 | −1175 | −111 | −546 |
| 6 | −892 | −307 | −315 |
| 7 | −762 | −111 | −336 |
| 8 | −566 | −405 | −735 |
| 9 | −501 | −846 | −483 |
| 10 | −631 | −503 | −420 |
| 11 | −370 | −479 | −252 |
| 12 | −523 | −307 | −462 |
| 13 | −327 | −185 | −294 |
| 14 | −631 | −332 | −231 |
| 15 | −544 | −136 | −273 |
| 16 | −1170 | −348 | −24 |
| 17 | −949 | −564 | −96 |
| 18 | −897 | −372 | 120 |
| 19 | −637 | −828 | 144 |
| 20 | −845 | −108 | −96 |
| 21 | −676 | −132 | 120 |
| 22 | −910 | −324 | 552 |
| 23 | −624 | −108 | 432 |
| 24 | −572 | −492 | −168 |
| 25 | −416 | −276 | −24 |
| 26 | −598 | −420 | 48 |
| 27 | −390 | −324 | 336 |
| 28 | −494 | −108 | −96 |
| 29 | −429 | −276 | −168 |
| 30 | −533 | −252 | 144 |
| 31 | −364 | −180 | 168 |
| 32 | −1114 | 107 | −280 |
| 33 | −676 | 64 | −249 |
| 34 | −1333 | −86 | −125 |
| 35 | −913 | 193 | −233 |
| 36 | −1460 | 258 | −349 |
| 37 | −1114 | 473 | −481 |
| 38 | −949 | 451 | −109 |
| 39 | −639 | 559 | −140 |
| 40 | −384 | −43 | −357 |
| 41 | −329 | 43 | −187 |
| 42 | −603 | 43 | −47 |
| 43 | −365 | 86 | −1 |

-continued

Table of PRBA Dif[1, 3] VQ Codebook (8 Bit) Values

| n | x1(n) | x2(n) | x3(n) |
|---|---|---|---|
| 44 | −566 | 408 | −404 |
| 45 | −329 | 387 | −218 |
| 46 | −603 | 258 | −202 |
| 47 | −511 | 193 | −16 |
| 48 | −1089 | 94 | 77 |
| 49 | −732 | 157 | 58 |
| 50 | −1482 | 178 | 311 |
| 51 | −1014 | −53 | 370 |
| 52 | −751 | 199 | 292 |
| 53 | −582 | 388 | 136 |
| 54 | −789 | 220 | 604 |
| 55 | −751 | 598 | 389 |
| 56 | −432 | −32 | 214 |
| 57 | −414 | −53 | 19 |
| 58 | −526 | 157 | 233 |
| 59 | −320 | 136 | 233 |
| 60 | −376 | 3040 | 38 |
| 61 | −357 | 325 | 214 |
| 62 | −470 | 388 | 350 |
| 63 | −357 | 199 | 428 |
| 64 | −285 | −592 | −589 |
| 65 | −245 | −345 | −342 |
| 66 | −315 | −867 | −228 |
| 67 | −205 | −400 | −114 |
| 68 | −270 | −97 | −570 |
| 69 | −170 | −97 | −342 |
| 70 | −280 | −235 | −152 |
| 71 | −260 | −97 | −114 |
| 72 | −130 | −592 | −266 |
| 73 | −40 | −290 | −646 |
| 74 | −110 | −235 | −228 |
| 75 | −35 | −235 | −57 |
| 76 | −35 | −97 | −247 |
| 77 | −10 | −15 | −152 |
| 78 | −120 | −152 | −133 |
| 79 | −85 | −42 | −76 |
| 80 | −295 | −472 | 86 |
| 81 | −234 | −248 | 0 |
| 82 | −234 | −216 | 603 |
| 83 | −172 | −520 | 301 |
| 84 | −286 | −40 | 21 |
| 85 | −177 | −88 | 0 |
| 86 | −253 | −72 | 322 |
| 87 | −191 | −136 | 129 |
| 88 | −53 | −168 | 21 |
| 89 | −48 | −328 | 86 |
| 90 | −105 | −264 | 236 |
| 91 | −67 | −136 | 129 |
| 92 | −53 | −40 | 21 |
| 93 | −6 | −104 | −43 |
| 94 | −105 | −40 | 193 |
| 95 | −29 | −40 | 344 |
| 96 | −176 | 123 | −208 |
| 97 | −143 | 0 | −182 |
| 98 | −309 | 184 | −156 |
| 99 | −205 | 20 | −91 |
| 100 | −276 | 205 | −403 |
| 101 | −229 | 615 | −234 |
| 102 | −238 | 225 | −13 |
| 103 | −162 | 307 | −91 |
| 104 | −81 | 61 | −117 |
| 105 | −10 | 102 | −221 |
| 106 | −105 | 20 | −39 |
| 107 | −48 | 82 | −26 |
| 108 | −124 | 328 | −286 |
| 109 | −24 | 205 | −143 |
| 110 | −143 | 164 | −78 |
| 111 | −20 | 389 | −104 |
| 112 | −270 | 90 | 93 |
| 113 | −185 | 72 | 0 |
| 114 | −230 | 0 | 186 |
| 115 | −131 | 108 | 124 |
| 116 | −243 | 558 | 0 |
| 117 | −212 | 432 | 155 |
| 118 | −171 | 234 | 186 |

-continued

Table of PRBA Dif[1, 3] VQ Codebook (8 Bit) Values

| n | x1(n) | x2(n) | x3(n) |
|---|---|---|---|
| 119 | −158 | 126 | 279 |
| 120 | −108 | 0 | 93 |
| 121 | −36 | 54 | 62 |
| 122 | −41 | 144 | 480 |
| 123 | 0 | 54 | 170 |
| 124 | −90 | 180 | 62 |
| 125 | 4 | 162 | 0 |
| 126 | −117 | 558 | 256 |
| 127 | −81 | 342 | 77 |
| 128 | 52 | −363 | −357 |
| 129 | 52 | −231 | −186 |
| 130 | 37 | −627 | 15 |
| 131 | 42 | −396 | −155 |
| 132 | 33 | −66 | −465 |
| 133 | 80 | −66 | −140 |
| 134 | 71 | −165 | −31 |
| 135 | 90 | −33 | −16 |
| 136 | 151 | −198 | −140 |
| 137 | 332 | −1023 | −186 |
| 138 | 109 | −363 | 0 |
| 139 | 204 | −165 | −16 |
| 140 | 180 | −132 | −279 |
| 141 | 284 | −99 | −155 |
| 142 | 151 | −66 | −93 |
| 143 | 185 | −33 | 15 |
| 144 | 46 | −170 | 112 |
| 145 | 146 | −120 | 89 |
| 146 | 78 | −382 | 292 |
| 147 | 78 | −145 | 224 |
| 148 | 15 | −32 | 89 |
| 149 | 41 | −82 | 22 |
| 150 | 10 | −70 | 719 |
| 151 | 115 | −32 | 89 |
| 152 | 162 | −282 | 134 |
| 153 | 304 | −345 | 22 |
| 154 | 225 | −270 | 674 |
| 155 | 335 | −407 | 359 |
| 156 | 256 | −57 | 179 |
| 157 | 314 | −182 | 112 |
| 158 | 146 | −45 | 404 |
| 159 | 241 | −195 | 292 |
| 160 | 27 | 96 | −89 |
| 161 | 56 | 128 | −362 |
| 162 | 4 | 0 | −30 |
| 163 | 103 | 32 | −69 |
| 164 | 18 | 432 | −459 |
| 165 | 61 | 256 | −615 |
| 166 | 94 | 272 | −206 |
| 167 | 99 | 144 | −550 |
| 168 | 113 | 16 | −225 |
| 169 | 298 | 80 | −362 |
| 170 | 213 | 48 | −50 |
| 171 | 255 | 32 | −186 |
| 172 | 156 | 144 | −167 |
| 173 | 265 | 320 | −24 |
| 174 | 122 | 496 | −30 |
| 175 | 298 | 176 | −69 |
| 176 | 56 | 66 | 45 |
| 177 | 61 | 145 | 112 |
| 178 | 32 | 225 | 270 |
| 179 | 99 | 13 | 225 |
| 180 | 28 | 304 | 45 |
| 181 | 118 | 251 | 0 |
| 182 | 118 | 808 | 697 |
| 183 | 142 | 437 | 157 |
| 184 | 156 | 92 | 45 |
| 185 | 317 | 13 | 22 |
| 186 | 194 | 145 | 270 |
| 187 | 260 | 66 | 90 |
| 188 | 194 | 834 | 45 |
| 189 | 327 | 225 | 45 |
| 190 | 189 | 278 | 495 |
| 191 | 199 | 225 | 135 |
| 192 | 336 | −205 | −390 |
| 193 | 364 | −740 | −656 |

-continued

Table of PRBA Dif[1, 3] VQ Codebook (8 Bit) Values

| n | x1(n) | x2(n) | x3(n) |
|---|---|---|---|
| 194 | 336 | −383 | −144 |
| 195 | 448 | −281 | −349 |
| 196 | 420 | 25 | −103 |
| 197 | 476 | −26 | −267 |
| 198 | 336 | −128 | −21 |
| 199 | 476 | −205 | −41 |
| 200 | 616 | −562 | −308 |
| 201 | 2100 | −460 | −164 |
| 202 | 644 | −358 | −103 |
| 203 | 1148 | −434 | −62 |
| 204 | 672 | −230 | −595 |
| 205 | 1344 | −332 | −615 |
| 206 | 644 | −52 | −164 |
| 207 | 896 | −205 | −287 |
| 208 | 460 | −363 | 176 |
| 209 | 560 | −660 | 0 |
| 210 | 360 | −924 | 572 |
| 211 | 360 | −627 | 198 |
| 212 | 420 | −99 | 308 |
| 213 | 540 | −66 | 154 |
| 214 | 380 | 99 | 396 |
| 215 | 500 | −66 | 572 |
| 216 | 780 | −264 | 66 |
| 217 | 1620 | −165 | 198 |
| 218 | 640 | −165 | 308 |
| 219 | 840 | −561 | 374 |
| 220 | 560 | 66 | 44 |
| 221 | 820 | 0 | 110 |
| 222 | 760 | −66 | 660 |
| 223 | 860 | −99 | 396 |
| 224 | 672 | 246 | −360 |
| 225 | 840 | 101 | −144 |
| 226 | 504 | 217 | −90 |
| 227 | 714 | 246 | 0 |
| 228 | 462 | 681 | −378 |
| 229 | 693 | 536 | −234 |
| 230 | 399 | 420 | −18 |
| 231 | 882 | 797 | 18 |
| 232 | 1155 | 188 | −216 |
| 233 | 1722 | 217 | −396 |
| 234 | 987 | 275 | 108 |
| 235 | 1197 | 130 | 126 |
| 236 | 1281 | 594 | −180 |
| 237 | 1302 | 1000 | −432 |
| 238 | 1155 | 565 | 108 |
| 239 | 1638 | 304 | 72 |
| 240 | 403 | 118 | 183 |
| 241 | 557 | 295 | 131 |
| 242 | 615 | 265 | 376 |
| 243 | 673 | 324 | 673 |
| 244 | 384 | 560 | 183 |
| 245 | 673 | 501 | 148 |
| 246 | 365 | 442 | 411 |
| 247 | 384 | 324 | 236 |
| 248 | 827 | 147 | 323 |
| 249 | 961 | 413 | 411 |
| 250 | 1058 | 177 | 463 |
| 251 | 1443 | 147 | 446 |
| 252 | 1000 | 1032 | 166 |
| 253 | 1558 | 708 | 253 |
| 254 | 692 | 678 | 411 |
| 255 | 1154 | 708 | 481 |

Table of PRBA Dif[1, 3] VQ Codebook (8 Bit) Values

| n | x1(n) | x2(n) | x3(n) | x4(n) |
|---|---|---|---|---|
| 0 | −279 | −330 | −261 | 7 |
| 1 | −465 | −242 | −9 | 7 |
| 2 | −248 | −66 | −189 | 7 |

-continued

Table of PRBA Dif[1, 3] VQ Codebook (8 Bit) Values

| n | x1(n) | x2(n) | x3(n) | x4(n) |
|---|---|---|---|---|
| 3 | −279 | −44 | 27 | 217 |
| 4 | −217 | −198 | −189 | −233 |
| 5 | −155 | −154 | −81 | −53 |
| 6 | −62 | −110 | −117 | 157 |
| 7 | 0 | −44 | −153 | −53 |
| 8 | −186 | −110 | 63 | −203 |
| 9 | −310 | 0 | 207 | −53 |
| 10 | −155 | −242 | 99 | 187 |
| 11 | −155 | −88 | 63 | 7 |
| 12 | −124 | −330 | 27 | −23 |
| 13 | 0 | −110 | 207 | −113 |
| 14 | −62 | −22 | 27 | 157 |
| 15 | −93 | 0 | 279 | 127 |
| 16 | −413 | 48 | −93 | −115 |
| 17 | −203 | 96 | −56 | −23 |
| 18 | −443 | 168 | −130 | 138 |
| 19 | −143 | 288 | −130 | 115 |
| 20 | −113 | 0 | −93 | −138 |
| 21 | −53 | 240 | −241 | −115 |
| 22 | −83 | 72 | −130 | 92 |
| 23 | −53 | 192 | −19 | −23 |
| 24 | −113 | 48 | 129 | −92 |
| 25 | −323 | 240 | 129 | −92 |
| 26 | −83 | 72 | 92 | 46 |
| 27 | −263 | 120 | 92 | 69 |
| 28 | −23 | 168 | 314 | −69 |
| 29 | −53 | 360 | 92 | −138 |
| 30 | −23 | 0 | −19 | 0 |
| 31 | 7 | 192 | 55 | 207 |
| 32 | 7 | −275 | −296 | −45 |
| 33 | 63 | −209 | −72 | −15 |
| 34 | 91 | −253 | −8 | 225 |
| 35 | 91 | −55 | −40 | 45 |
| 36 | 119 | −99 | −72 | −225 |
| 37 | 427 | −77 | −72 | −135 |
| 38 | 399 | −121 | −200 | 105 |
| 39 | 175 | −33 | −104 | −75 |
| 40 | 7 | −99 | 24 | −75 |
| 41 | 91 | 11 | 88 | −15 |
| 42 | 119 | −165 | 152 | 45 |
| 43 | 35 | −55 | 88 | 75 |
| 44 | 231 | −319 | 120 | −105 |
| 45 | 231 | −55 | 184 | −165 |
| 46 | 259 | −143 | −8 | 15 |
| 47 | 371 | −11 | 152 | 45 |
| 48 | 60 | 71 | −63 | −55 |
| 49 | 12 | 159 | −63 | −241 |
| 50 | 60 | 71 | −21 | 69 |
| 51 | 60 | 115 | −105 | 162 |
| 52 | 108 | 5 | −357 | −148 |
| 53 | 372 | 93 | −231 | −179 |
| 54 | 132 | 5 | −231 | 100 |
| 55 | 180 | 225 | −147 | 7 |
| 56 | 36 | 27 | 63 | −148 |
| 57 | 60 | 203 | 105 | −24 |
| 58 | 108 | 93 | 189 | 100 |
| 59 | 156 | 335 | 273 | 69 |
| 60 | 204 | 93 | 21 | 38 |
| 61 | 252 | 159 | 63 | −148 |
| 62 | 180 | 5 | 21 | 224 |
| 63 | 349 | 269 | 63 | 69 |

Table of HCO Sum0 VQ Codebook (7 Bit) Values

| n | x1(n) | x2(n) | x3(n) | x4(n) |
|---|---|---|---|---|
| 0 | −1087 | −987 | −785 | −114 |
| 1 | −742 | −903 | −639 | −570 |
| 2 | −1363 | −567 | −639 | −342 |
| 3 | −604 | −315 | −639 | −456 |

-continued

Table of HCO Sum0 VQ Codebook (7 Bit) Values

| n | x1(n) | x2(n) | x3(n) | x4(n) |
|---|---|---|---|---|
| 4 | −1501 | −1491 | −712 | 1026 |
| 5 | −949 | −819 | −274 | 0 |
| 6 | −880 | −399 | −493 | −114 |
| 7 | −742 | −483 | −566 | 342 |
| 8 | −880 | −651 | 237 | −114 |
| 9 | −742 | −483 | −201 | −342 |
| 10 | −1294 | −231 | −128 | −114 |
| 11 | −1156 | −315 | −128 | −684 |
| 12 | −1639 | −819 | 18 | 0 |
| 13 | −604 | −567 | 18 | 342 |
| 14 | −949 | −315 | 310 | 456 |
| 15 | −811 | −315 | −55 | 114 |
| 16 | −384 | −666 | −282 | −593 |
| 17 | −358 | −170 | −564 | −198 |
| 18 | −514 | −522 | −376 | −119 |
| 19 | −254 | −378 | −188 | −277 |
| 20 | −254 | −666 | −940 | −40 |
| 21 | −228 | −378 | −376 | 118 |
| 22 | −566 | −162 | −564 | 118 |
| 23 | −462 | −234 | −188 | 39 |
| 24 | −436 | −306 | 94 | −198 |
| 25 | −436 | −738 | 0 | −119 |
| 26 | −436 | −306 | 376 | −119 |
| 27 | −332 | −90 | 188 | 39 |
| 28 | −280 | −378 | −94 | 592 |
| 29 | −254 | −450 | 5 | 229 |
| 30 | −618 | −162 | 188 | 118 |
| 31 | −228 | −234 | 470 | 355 |
| 32 | −1806 | −49 | −245 | −358 |
| 33 | −860 | −49 | −245 | −199 |
| 34 | −602 | 341 | −49 | −358 |
| 35 | −602 | 146 | −931 | −252 |
| 36 | −774 | 81 | 49 | 13 |
| 37 | −602 | 81 | 49 | 384 |
| 38 | −946 | 3341 | −440 | 225 |
| 39 | −688 | 406 | −147 | −93 |
| 40 | −860 | −49 | 147 | −411 |
| 41 | −688 | −49 | 147 | −411 |
| 42 | −1290 | 276 | 49 | −305 |
| 43 | −774 | 926 | 147 | −252 |
| 44 | −1462 | 146 | 343 | 66 |
| 45 | −1032 | −49 | 441 | −40 |
| 46 | −946 | 471 | 147 | 172 |
| 47 | −516 | 211 | 539 | 172 |
| 48 | −481 | −28 | −290 | −435 |
| 49 | −277 | −28 | −351 | −195 |
| 50 | −345 | 687 | −107 | −375 |
| 51 | −294 | 247 | −107 | −135 |
| 52 | −362 | 27 | −46 | −15 |
| 53 | −328 | 82 | −290 | 345 |
| 54 | −464 | 192 | −229 | 45 |
| 55 | −396 | 467 | −351 | 105 |
| 56 | −396 | −83 | 442 | −435 |
| 57 | −243 | 82 | 259 | −255 |
| 58 | −447 | 82 | 15 | −255 |
| 59 | −294 | 742 | 564 | −135 |
| 60 | −260 | −83 | 15 | 225 |
| 61 | −243 | 192 | 259 | 465 |
| 62 | −328 | 247 | 137 | −15 |
| 63 | −226 | 632 | 137 | 105 |
| 64 | −170 | −641 | −436 | −221 |
| 65 | 130 | −885 | −187 | −273 |
| 66 | −30 | −153 | −519 | −377 |
| 67 | 30 | −519 | −851 | −533 |
| 68 | −170 | −214 | −602 | −65 |
| 69 | −70 | −641 | −270 | 247 |
| 70 | −150 | −214 | −104 | 39 |
| 71 | −10 | −31 | −270 | 195 |
| 72 | 10 | −458 | 394 | −117 |
| 73 | 70 | −519 | −21 | −221 |
| 74 | −130 | −275 | 145 | −481 |
| 75 | −110 | −31 | 62 | −221 |
| 76 | −110 | −641 | 228 | 91 |
| 77 | 70 | −275 | −21 | 39 |
| 78 | −90 | −214 | 145 | −65 |

-continued

Table of HCO Sum0 VQ Codebook (7 Bit) Values

| n | x1(n) | x2(n) | x3(n) | x4(n) |
|---|---|---|---|---|
| 79 | −30 | 30 | −21 | 39 |
| 80 | 326 | −587 | −490 | −72 |
| 81 | 821 | −252 | −490 | −186 |
| 82 | 146 | −252 | −266 | −72 |
| 83 | 506 | −185 | −210 | −357 |
| 84 | 281 | −252 | −378 | 270 |
| 85 | 551 | −319 | −154 | 156 |
| 86 | 416 | −51 | −266 | −15 |
| 87 | 596 | 16 | −378 | 384 |
| 88 | 506 | −319 | 182 | −243 |
| 89 | 776 | −721 | 70 | 99 |
| 90 | 236 | −185 | 70 | −186 |
| 91 | 731 | −51 | 126 | 99 |
| 92 | 191 | −386 | −98 | 156 |
| 93 | 281 | −989 | −154 | 498 |
| 94 | 281 | −185 | 14 | 213 |
| 95 | 281 | −386 | 350 | 156 |
| 96 | −18 | 144 | −254 | −192 |
| 97 | 97 | 144 | −410 | 0 |
| 98 | −179 | 464 | −410 | −256 |
| 99 | 28 | 464 | −98 | −192 |
| 100 | −156 | 144 | −176 | 64 |
| 101 | 143 | 80 | −98 | 0 |
| 102 | −133 | 336 | −98 | 192 |
| 103 | 143 | 656 | −488 | 128 |
| 104 | −133 | 208 | −20 | −576 |
| 105 | 74 | 16 | 448 | −192 |
| 106 | −18 | 208 | 58 | −128 |
| 107 | 120 | 976 | 58 | 0 |
| 108 | 5 | 144 | 370 | 192 |
| 109 | 120 | 80 | 136 | 384 |
| 110 | 74 | 464 | 682 | 256 |
| 111 | 120 | 464 | 136 | 64 |
| 112 | 181 | 96 | −43 | −400 |
| 113 | 379 | 182 | −215 | −272 |
| 114 | 313 | 483 | −559 | −336 |
| 115 | 1105 | 225 | −43 | −80 |
| 116 | 181 | 225 | −559 | 240 |
| 117 | 643 | 182 | −473 | −80 |
| 118 | 313 | 225 | −129 | 112 |
| 119 | 511 | 397 | −43 | −16 |
| 120 | 379 | 139 | 215 | 48 |
| 121 | 775 | 182 | 559 | 48 |
| 122 | 247 | 354 | 301 | −272 |
| 123 | 643 | 655 | 301 | −16 |
| 124 | 247 | 53 | 731 | 176 |
| 125 | 445 | 10 | 215 | 560 |
| 126 | 577 | 526 | 215 | 368 |
| 127 | 1171 | 569 | 387 | 176 |

Table of HOC Dif0 VQ Codebook (3 Bit) Values

| n | x1(n) | x2(n) | x3(n) | x4(n) |
|---|---|---|---|---|
| 0 | −558 | −117 | 0 | 0 |
| 1 | −248 | 195 | 88 | −22 |
| 2 | −186 | −312 | −176 | −44 |
| 3 | 0 | 0 | 0 | 77 |
| 4 | 0 | −117 | 154 | −88 |
| 5 | 62 | 156 | −176 | −55 |
| 6 | 310 | −156 | −66 | 22 |
| 7 | 372 | 273 | 110 | 33 |

Table of HOC Sum1 VQ Codebook (7 Bit) Values

| n | x1(n) | x2(n) | x3(n) | x4(n) |
|---|---|---|---|---|
| 0 | −380 | −528 | −363 | 71 |
| 1 | −380 | −528 | −13 | 14 |
| 2 | −1040 | −186 | −313 | −214 |
| 3 | −578 | −300 | −113 | −157 |
| 4 | −974 | −471 | −163 | 71 |
| 5 | −512 | −300 | −313 | 299 |
| 6 | −578 | −129 | 37 | 185 |
| 7 | −314 | −186 | −113 | 71 |
| 8 | −446 | −357 | 237 | −385 |
| 9 | −380 | −870 | 237 | 14 |
| 10 | −776 | −72 | 187 | −43 |
| 11 | −446 | −243 | 87 | −100 |
| 12 | −644 | −414 | 387 | 71 |
| 13 | −578 | −642 | 87 | −100 |
| 14 | −1304 | −15 | 237 | 128 |
| 15 | −644 | −300 | 187 | 470 |
| 16 | −221 | −452 | −385 | −309 |
| 17 | −77 | −200 | −165 | −179 |
| 18 | −221 | −200 | −110 | −504 |
| 19 | −149 | −200 | −440 | −114 |
| 20 | −221 | −326 | 0 | 276 |
| 21 | −95 | −662 | −165 | 406 |
| 22 | −95 | −32 | −220 | 16 |
| 23 | −23 | −158 | −440 | 146 |
| 24 | −167 | −410 | 220 | −114 |
| 25 | −95 | −158 | 110 | 16 |
| 26 | −203 | −74 | 220 | −244 |
| 27 | −59 | −74 | 385 | −114 |
| 28 | −275 | −116 | 165 | 211 |
| 29 | −5 | −452 | 220 | 341 |
| 30 | −113 | −74 | 330 | 471 |
| 31 | −77 | −116 | 0 | 211 |
| 32 | −642 | 57 | −143 | −406 |
| 33 | −507 | 0 | −371 | −70 |
| 34 | −1047 | 570 | −143 | −14 |
| 35 | −417 | 855 | −200 | 42 |
| 36 | −912 | 0 | −143 | 98 |
| 37 | −417 | 171 | −143 | 266 |
| 38 | −687 | 285 | 28 | 98 |
| 39 | −372 | 513 | −371 | 154 |
| 40 | −822 | 0 | 427 | −294 |
| 41 | −462 | 171 | 142 | −238 |
| 42 | −1047 | 342 | 313 | −70 |
| 43 | −507 | 570 | 142 | −406 |
| 44 | −552 | 114 | 313 | 434 |
| 45 | −462 | 57 | 28 | −70 |
| 46 | −507 | 342 | 484 | 210 |
| 47 | −507 | 513 | 85 | 42 |
| 48 | −210 | 40 | −140 | −226 |
| 49 | −21 | 0 | 0 | −54 |
| 50 | −336 | 360 | −210 | −226 |
| 51 | −126 | 280 | 70 | −312 |
| 52 | −252 | 200 | 0 | −11 |
| 53 | −63 | 160 | −420 | 161 |
| 54 | −168 | 240 | −210 | 32 |
| 55 | −42 | 520 | −280 | −54 |
| 56 | −336 | 0 | 350 | 32 |
| 57 | −126 | 240 | 420 | −269 |
| 58 | −315 | 320 | 280 | −54 |
| 59 | −147 | 600 | 140 | 32 |
| 60 | −336 | 120 | 70 | 161 |
| 61 | −63 | 120 | 140 | 75 |
| 62 | −210 | 360 | 70 | 333 |
| 63 | −63 | 200 | 630 | 118 |
| 64 | 168 | −793 | −315 | −171 |
| 65 | 294 | −273 | −378 | −399 |
| 66 | 147 | −117 | −126 | −57 |
| 67 | 231 | −169 | −378 | −114 |
| 68 | 0 | −325 | −63 | 0 |
| 69 | 84 | −481 | −252 | 171 |
| 70 | 105 | −221 | −189 | 228 |
| 71 | 294 | −273 | 0 | 456 |
| 72 | 126 | −585 | 0 | −114 |
| 73 | 147 | −325 | 252 | −228 |
| 74 | 147 | −169 | 63 | −171 |

-continued

Table of HOC Sum1 VQ Codebook (7 Bit) Values

| n | x1(n) | x2(n) | x3(n) | x4(n) |
|---|---|---|---|---|
| 75 | 315 | −13 | 567 | −171 |
| 76 | 126 | −377 | 504 | 57 |
| 77 | 147 | −273 | 63 | 57 |
| 78 | 63 | −169 | 252 | 171 |
| 79 | 273 | −117 | 63 | 57 |
| 80 | 736 | −332 | −487 | −96 |
| 81 | 1748 | −179 | −192 | −32 |
| 82 | 736 | −26 | −369 | −416 |
| 83 | 828 | −26 | −192 | −32 |
| 84 | 460 | −638 | −251 | 160 |
| 85 | 736 | −230 | −133 | 288 |
| 86 | 368 | −230 | −133 | 32 |
| 87 | 552 | −77 | −487 | 544 |
| 88 | 736 | −434 | 44 | −32 |
| 89 | 1104 | −332 | −74 | −32 |
| 90 | 460 | −281 | −15 | −224 |
| 91 | 644 | −281 | 398 | −160 |
| 92 | 368 | −791 | 221 | 32 |
| 93 | 460 | −383 | 103 | 32 |
| 94 | 644 | −281 | 162 | 224 |
| 95 | 1012 | −179 | 339 | 160 |
| 96 | 76 | 108 | −341 | −244 |
| 97 | 220 | 54 | −93 | −488 |
| 98 | 156 | 378 | −589 | −122 |
| 99 | 188 | 216 | −155 | 0 |
| 100 | 28 | 0 | −31 | 427 |
| 101 | 108 | 0 | 31 | 61 |
| 102 | −4 | 162 | −93 | 183 |
| 103 | 204 | 432 | −217 | 305 |
| 104 | 44 | 162 | 31 | −122 |
| 105 | 156 | 0 | 217 | −427 |
| 106 | 44 | 810 | 279 | −122 |
| 107 | 204 | 378 | 217 | −305 |
| 108 | 124 | 108 | 217 | 244 |
| 109 | 220 | 108 | 341 | −61 |
| 110 | 44 | 432 | 217 | 0 |
| 111 | 156 | 432 | 279 | 427 |
| 112 | 300 | −13 | −89 | −163 |
| 113 | 550 | 237 | −266 | −13 |
| 114 | 450 | 737 | −30 | −363 |
| 115 | 1050 | 387 | −30 | −213 |
| 116 | 300 | −13 | −384 | 137 |
| 117 | 350 | 87 | −89 | 187 |
| 118 | 300 | 487 | −89 | −13 |
| 119 | 900 | 237 | −443 | 37 |
| 120 | 500 | −13 | 88 | −63 |
| 121 | 700 | 187 | 442 | −13 |
| 122 | 450 | 237 | 29 | −263 |
| 123 | 700 | 387 | 88 | 37 |
| 124 | 300 | 187 | 88 | 37 |
| 125 | 350 | −13 | 324 | 237 |
| 126 | 600 | 237 | 29 | 387 |
| 127 | 700 | 687 | 442 | 187 |

Table of HOC Dif1 VQ Codebook (3 Bit) Values

| n | x1(n) | x2(n) | x3(n) | x4(n) |
|---|---|---|---|---|
| 0 | −173 | −285 | 5 | 28 |
| 1 | −35 | 19 | −179 | 76 |
| 2 | −357 | 57 | 51 | −20 |
| 3 | −127 | 285 | 51 | −20 |
| 4 | 11 | −19 | 5 | −116 |
| 5 | 333 | −171 | −41 | 28 |
| 6 | 11 | −19 | 143 | 124 |
| 7 | 333 | 209 | −41 | −36 |

Table of HOC Sum2 VQ Codebook (7 Bit) Values

| n | x1(n) | x2(n) | x3(n) | x4(n) |
|---|---|---|---|---|
| 0 | −738 | −670 | −429 | −179 |
| 1 | −450 | −335 | −99 | −53 |
| 2 | −450 | −603 | −99 | 115 |
| 3 | −306 | −201 | −231 | 157 |
| 4 | −810 | −201 | −33 | −137 |
| 5 | −378 | −134 | −231 | −305 |
| 6 | −1386 | −67 | −33 | −95 |
| 7 | −666 | −201 | −363 | 283 |
| 8 | −450 | −402 | 297 | −53 |
| 9 | −378 | −670 | 561 | −11 |
| 10 | −1098 | −402 | 231 | 325 |
| 11 | −594 | −1005 | 99 | −11 |
| 12 | −882 | 0 | 99 | 157 |
| 13 | −810 | −268 | 363 | −179 |
| 14 | −594 | −335 | 99 | 283 |
| 15 | −306 | −201 | 165 | 157 |
| 16 | −200 | −513 | −162 | −288 |
| 17 | −40 | −323 | −162 | −96 |
| 18 | −200 | −589 | −378 | 416 |
| 19 | −56 | −513 | −378 | −32 |
| 20 | −248 | −285 | −522 | 32 |
| 21 | −184 | −133 | −18 | −32 |
| 22 | −120 | −19 | −234 | 96 |
| 23 | −56 | −133 | −234 | 416 |
| 24 | −200 | −437 | −18 | 96 |
| 25 | −168 | −209 | 414 | −288 |
| 26 | −152 | −437 | 198 | 544 |
| 27 | −56 | −171 | 54 | 160 |
| 28 | −184 | −95 | 54 | −416 |
| 29 | −152 | −171 | 198 | −32 |
| 30 | −280 | −171 | 558 | 96 |
| 31 | −184 | −19 | 270 | 288 |
| 32 | −463 | 57 | −228 | 40 |
| 33 | −263 | 114 | −293 | −176 |
| 34 | −413 | 57 | 32 | 472 |
| 35 | −363 | 228 | −423 | 202 |
| 36 | −813 | 399 | −358 | −68 |
| 37 | −563 | 399 | 32 | −122 |
| 38 | −463 | 342 | −33 | 202 |
| 39 | −413 | 627 | −163 | 202 |
| 40 | −813 | 171 | 162 | −338 |
| 41 | −413 | 0 | 97 | −176 |
| 42 | −513 | 57 | 422 | −14 |
| 43 | −463 | 0 | 97 | 94 |
| 44 | −663 | 570 | 357 | −230 |
| 45 | −313 | 855 | 227 | −14 |
| 46 | −1013 | 513 | 162 | 40 |
| 47 | −813 | 228 | 552 | 256 |
| 48 | −225 | 82 | 0 | 63 |
| 49 | −63 | 246 | −80 | 63 |
| 50 | −99 | 82 | −80 | 273 |
| 51 | −27 | 246 | −320 | 63 |
| 52 | −81 | 697 | −240 | −357 |
| 53 | −45 | 410 | −640 | −147 |
| 54 | −261 | 369 | −160 | −105 |
| 55 | −63 | 656 | −80 | 63 |
| 56 | −261 | 205 | 240 | −21 |
| 57 | −99 | 82 | 0 | −147 |
| 58 | −171 | 287 | 560 | 105 |
| 59 | 9 | 246 | 160 | 189 |
| 60 | −153 | 287 | 0 | −357 |
| 61 | −99 | 287 | 400 | −315 |
| 62 | −225 | 492 | 240 | 231 |
| 63 | −45 | 328 | 80 | −63 |
| 64 | 105 | −989 | −124 | −102 |
| 65 | 185 | −453 | −389 | −372 |
| 66 | 145 | −788 | 41 | 168 |
| 67 | 145 | −252 | −289 | 168 |
| 68 | 5 | −118 | −234 | −57 |
| 69 | 165 | −118 | −179 | −282 |
| 70 | 145 | −185 | −69 | −57 |
| 71 | 225 | −185 | −14 | 303 |
| 72 | 105 | −185 | 151 | −237 |
| 73 | 225 | −587 | 261 | −282 |
| 74 | 65 | −386 | 151 | 78 |

-continued

Table of HOC Sum2 VQ Codebook (7 Bit) Values

| n | x1(n) | x2(n) | x3(n) | x4(n) |
|---|---|---|---|---|
| 75 | 305 | −252 | 371 | −147 |
| 76 | 245 | −51 | 96 | −57 |
| 77 | 265 | 16 | 316 | −237 |
| 78 | 45 | 185 | 536 | 78 |
| 79 | 205 | −185 | 261 | 213 |
| 80 | 346 | −544 | −331 | −30 |
| 81 | 913 | −298 | −394 | −207 |
| 82 | 472 | −216 | −583 | 29 |
| 83 | 598 | −339 | −142 | 206 |
| 84 | 472 | −175 | −268 | −207 |
| 85 | 598 | −52 | −205 | 29 |
| 86 | 346 | −11 | −457 | 442 |
| 87 | 850 | −52 | −205 | 383 |
| 88 | 346 | −380 | −16 | −30 |
| 89 | 724 | −626 | 47 | −89 |
| 90 | 409 | −380 | 236 | 206 |
| 91 | 1291 | −216 | −16 | 29 |
| 92 | 472 | −11 | 47 | −443 |
| 93 | 535 | −134 | 47 | −30 |
| 94 | 346 | −52 | −79 | 147 |
| 95 | 787 | −175 | 362 | 29 |
| 96 | 85 | 220 | −195 | −170 |
| 97 | 145 | 110 | −375 | −510 |
| 98 | 45 | 55 | −495 | −34 |
| 99 | 185 | 55 | −195 | 238 |
| 100 | 245 | 440 | −75 | −374 |
| 101 | 285 | 825 | −75 | 102 |
| 102 | 85 | 330 | −255 | 374 |
| 103 | 185 | 330 | −75 | 102 |
| 104 | 25 | 110 | 285 | −34 |
| 105 | 65 | 55 | −15 | 34 |
| 106 | 65 | 0 | 105 | 102 |
| 107 | 225 | 55 | 105 | 510 |
| 108 | 105 | 110 | 45 | −238 |
| 109 | 325 | 550 | 165 | −102 |
| 110 | 105 | 440 | 405 | 34 |
| 111 | 265 | 165 | 165 | 102 |
| 112 | 320 | 112 | −32 | −74 |
| 113 | 896 | 194 | −410 | 10 |
| 114 | 320 | 114 | −284 | 10 |
| 115 | 512 | 276 | −95 | 220 |
| 116 | 448 | 317 | −410 | −326 |
| 117 | 1280 | 399 | −32 | −74 |
| 118 | 384 | 481 | −473 | 220 |
| 119 | 448 | 399 | −158 | 10 |
| 120 | 512 | 71 | 157 | 52 |
| 121 | 640 | 276 | −32 | −74 |
| 122 | 320 | 153 | 472 | 220 |
| 123 | 896 | 30 | 31 | 52 |
| 124 | 512 | 276 | 283 | −242 |
| 125 | 832 | 645 | 31 | −74 |
| 126 | 448 | 522 | 157 | 304 |
| 127 | 960 | 276 | 409 | 94 |

Table of HOC Dif2 VQ Codebook (3 Bit) Values

| n | x1(n) | x2(n) | x3(n) | x4(n) |
|---|---|---|---|---|
| 0 | −224 | −237 | 15 | −9 |
| 1 | −36 | −27 | −195 | −27 |
| 2 | −365 | 113 | 36 | 9 |
| 3 | −36 | 288 | −27 | −9 |
| 4 | 58 | 8 | 57 | 171 |
| 5 | 199 | −237 | 57 | −9 |
| 6 | −36 | 8 | 120 | −81 |
| 7 | 340 | 113 | −48 | −9 |

Table of HOC Sum3 VQ Codebook (7 Bit) Values

| n | x1(n) | x2(n) | x3(n) | x4(n) |
|---|---|---|---|---|
| 0 | −812 | −216 | −483 | −129 |
| 1 | −532 | −648 | −207 | −129 |
| 2 | −868 | −504 | 0 | 215 |
| 3 | −532 | −264 | −69 | 129 |
| 4 | −924 | −72 | 0 | −43 |
| 5 | −644 | −120 | −69 | −215 |
| 6 | −868 | −72 | −345 | −301 |
| 7 | −476 | −24 | −483 | 344 |
| 8 | −756 | −216 | 276 | 215 |
| 9 | −476 | −360 | 414 | 0 |
| 10 | −1260 | −120 | 0 | 258 |
| 11 | −476 | −264 | 69 | 430 |
| 12 | −924 | 24 | 552 | −43 |
| 13 | −644 | 72 | 276 | −129 |
| 14 | −476 | 24 | 0 | 43 |
| 15 | −420 | 24 | 345 | 172 |
| 16 | −390 | −357 | −406 | 0 |
| 17 | −143 | −471 | −350 | −186 |
| 18 | −162 | −471 | −182 | 310 |
| 19 | −143 | −699 | −3550 | 186 |
| 20 | −390 | −72 | −350 | −310 |
| 21 | −219 | 42 | −126 | −186 |
| 22 | −333 | −72 | −182 | 62 |
| 23 | −181 | −129 | −238 | 496 |
| 24 | −371 | −243 | 154 | −124 |
| 25 | −200 | −300 | −14 | −434 |
| 26 | −295 | −813 | 154 | 124 |
| 27 | −181 | −471 | 42 | −62 |
| 28 | −333 | −129 | 434 | −310 |
| 29 | −105 | −72 | 210 | −62 |
| 30 | −257 | −186 | 154 | 124 |
| 31 | −143 | −243 | −70 | −62 |
| 32 | −704 | 195 | −366 | −127 |
| 33 | −448 | 91 | −183 | −35 |
| 34 | −576 | 91 | −122 | 287 |
| 35 | −448 | 299 | −244 | 103 |
| 36 | −1216 | 611 | −305 | 57 |
| 37 | −384 | 507 | −244 | −127 |
| 38 | −704 | 559 | −488 | 149 |
| 39 | −640 | 455 | −183 | 379 |
| 40 | −1344 | 351 | 122 | −265 |
| 41 | −640 | 351 | −61 | −35 |
| 42 | −960 | 299 | 61 | 149 |
| 43 | −512 | 351 | 244 | 333 |
| 44 | −896 | 507 | −61 | −127 |
| 45 | −576 | 455 | 244 | −311 |
| 46 | −768 | 611 | 427 | 11 |
| 47 | −576 | 871 | 0 | 103 |
| 48 | −298 | 118 | −435 | 29 |
| 49 | −196 | 290 | −195 | −29 |
| 50 | −349 | 247 | −15 | 87 |
| 51 | −196 | 247 | −255 | 261 |
| 52 | −400 | 677 | −555 | −203 |
| 53 | −349 | 333 | −15 | −435 |
| 54 | −264 | 419 | −75 | 435 |
| 55 | −213 | 720 | −255 | 87 |
| 56 | −349 | 204 | 45 | −203 |
| 57 | −264 | 75 | 165 | 29 |
| 58 | −264 | 75 | −15 | 261 |
| 59 | −145 | 118 | −15 | 29 |
| 60 | −298 | 505 | 45 | −145 |
| 61 | −179 | 290 | 345 | −203 |
| 62 | −315 | 376 | 225 | 29 |
| 63 | −162 | 462 | −15 | 145 |
| 64 | −76 | −129 | −424 | −59 |
| 65 | 57 | −43 | −193 | −247 |
| 66 | −19 | −86 | −578 | 270 |
| 67 | 133 | −258 | −270 | 176 |
| 68 | 19 | −43 | −39 | −12 |
| 69 | 190 | 0 | −578 | −200 |
| 70 | −76 | 0 | −193 | 129 |
| 71 | 171 | 0 | −193 | 35 |
| 72 | 95 | −258 | 269 | −12 |
| 73 | 152 | −602 | 115 | −153 |
| 74 | −76 | −301 | 346 | 411 |

-continued

Table of HOC Sum3 VQ Codebook (7 Bit) Values

| n | x1(n) | x2(n) | x3(n) | x4(n) |
|---|---|---|---|---|
| 75 | 190 | −473 | 38 | 176 |
| 76 | 19 | −172 | 115 | −294 |
| 77 | 76 | −172 | 577 | −153 |
| 78 | −38 | −215 | 38 | 129 |
| 79 | 114 | −86 | 38 | 317 |
| 80 | 208 | −338 | −132 | −144 |
| 81 | 649 | −1958 | −462 | −964 |
| 82 | 453 | −473 | −462 | 102 |
| 83 | 845 | −68 | −198 | 102 |
| 84 | 502 | −68 | −396 | −226 |
| 85 | 943 | −68 | 0 | −308 |
| 86 | 404 | −68 | −198 | 102 |
| 87 | 600 | 67 | −528 | 184 |
| 88 | 453 | −338 | 132 | −308 |
| 89 | 796 | −608 | 0 | −62 |
| 90 | 355 | −473 | 396 | 184 |
| 91 | 551 | −338 | 0 | 184 |
| 92 | 208 | −203 | 66 | −62 |
| 93 | 698 | −203 | 462 | −62 |
| 94 | 208 | −68 | 264 | 266 |
| 95 | 551 | −68 | 132 | 20 |
| 96 | −98 | 269 | −281 | −290 |
| 97 | 21 | 171 | 49 | −174 |
| 98 | 4 | 220 | −83 | 58 |
| 99 | 106 | 122 | −215 | 464 |
| 100 | 21 | 465 | −149 | −116 |
| 101 | 21 | 318 | −347 | 0 |
| 102 | −98 | 514 | −479 | 406 |
| 103 | 123 | 514 | −83 | 174 |
| 104 | −13 | 122 | 181 | −406 |
| 105 | 140 | 24 | 247 | −58 |
| 106 | −98 | 220 | 511 | 174 |
| 107 | −30 | 73 | 181 | 174 |
| 108 | 4 | 759 | 181 | −174 |
| 109 | 21 | 318 | 181 | 58 |
| 110 | 38 | 318 | 115 | 464 |
| 111 | 106 | 710 | 379 | 174 |
| 112 | 289 | 270 | −162 | −135 |
| 113 | 289 | 35 | −216 | −351 |
| 114 | 289 | 270 | −378 | 189 |
| 115 | 561 | 129 | −54 | −27 |
| 116 | 357 | 552 | −162 | −351 |
| 117 | 765 | 364 | −324 | −27 |
| 118 | 221 | 270 | −108 | 189 |
| 119 | 357 | 740 | −432 | 135 |
| 120 | 221 | 82 | 0 | 81 |
| 121 | 357 | 82 | 162 | −243 |
| 122 | 561 | 129 | −54 | 459 |
| 123 | 1241 | 129 | 108 | 189 |
| 124 | 221 | 364 | 162 | −189 |
| 125 | 425 | 050 | −54 | 27 |
| 126 | 425 | 270 | 378 | 135 |
| 127 | 765 | 364 | 108 | 135 |

Table of HOC Dif3 VQ Codebook (3 Bit) Values

| n | x1(n) | x2(n) | x3(n) | x4(n) |
|---|---|---|---|---|
| 0 | −94 | −248 | 60 | 0 |
| 1 | 0 | −17 | −100 | −90 |
| 2 | −376 | −17 | 40 | 18 |
| 3 | −141 | 247 | −80 | 36 |
| 4 | 47 | −50 | −80 | 162 |
| 5 | 329 | −182 | 20 | −18 |
| 6 | 0 | 49 | 200 | 0 |
| 7 | 282 | 181 | −20 | −18 |

Table of Frequency Block Sizes

| Total number of sub-frame magnitudes | Number of magnitudes for Frequency Block 1 | Number of magnitudes for Frequency Block 2 | Number of magnitudes for Frequency Block 3 | Number of magnitudes for Frequency Block 4 |
|---|---|---|---|---|
| 9 | 2 | 2 | 2 | 3 |
| 10 | 2 | 2 | 3 | 3 |
| 11 | 2 | 3 | 3 | 3 |
| 12 | 2 | 3 | 3 | 4 |
| 13 | 3 | 3 | 3 | 4 |
| 14 | 3 | 3 | 4 | 4 |
| 15 | 3 | 3 | 4 | 5 |
| 16 | 3 | 4 | 4 | 5 |
| 17 | 3 | 4 | 5 | 5 |
| 18 | 4 | 4 | 5 | 5 |
| 19 | 4 | 4 | 5 | 6 |
| 20 | 4 | 4 | 6 | 6 |
| 21 | 4 | 5 | 6 | 6 |
| 22 | 4 | 5 | 6 | 7 |
| 23 | 5 | 5 | 6 | 7 |
| 24 | 5 | 5 | 7 | 7 |
| 25 | 5 | 6 | 7 | 7 |
| 26 | 5 | 6 | 7 | 8 |
| 27 | 5 | 6 | 8 | 8 |
| 28 | 6 | 6 | 8 | 8 |
| 29 | 6 | 6 | 8 | 9 |
| 30 | 6 | 7 | 8 | 9 |
| 31 | 6 | 7 | 9 | 9 |
| 32 | 6 | 7 | 9 | 10 |
| 33 | 7 | 7 | 9 | 10 |
| 34 | 7 | 8 | 9 | 10 |
| 35 | 7 | 8 | 10 | 10 |
| 36 | 7 | 8 | 10 | 11 |
| 37 | 8 | 8 | 10 | 11 |
| 39 | 8 | 9 | 11 | 11 |
| 40 | 8 | 9 | 11 | 12 |
| 41 | 8 | 9 | 11 | 13 |
| 42 | 8 | 9 | 12 | 13 |
| 43 | 8 | 10 | 12 | 13 |
| 44 | 9 | 10 | 12 | 13 |
| 45 | 9 | 10 | 12 | 14 |
| 46 | 9 | 10 | 13 | 14 |
| 47 | 9 | 11 | 13 | 14 |
| 48 | 10 | 11 | 13 | 14 |
| 49 | 10 | 11 | 13 | 15 |
| 50 | 10 | 11 | 14 | 15 |
| 51 | 10 | 12 | 14 | 15 |
| 52 | 10 | 12 | 14 | 16 |
| 53 | 11 | 12 | 14 | 16 |
| 54 | 11 | 12 | 15 | 16 |
| 55 | 11 | 12 | 15 | 17 |
| 56 | 11 | 13 | 15 | 17 |

What is claimed is:

1. A method of encoding speech into a frame of bits, the method including:

digitizing a speech signal into a sequence of digital speech samples;

dividing the digital speech samples into a sequence of subframes, each of the subframes including multiple digital speech samples;

estimating a set of speech model parameters for each subframe, wherein the speech model parameters include a set of spectral magnitude parameters that represent spectral magnitude information for the subframe;

combining consecutive subframes from the sequence of subframes into a frame;

jointly quantizing the spectral magnitude parameters from the consecutive subframes of the frame to produce a set of encoder spectral bits, wherein:

the joint quantization includes forming predicted spectral magnitude parameters from quantized spectral magnitude parameters from a previous subframe;

a subframe of the frame includes a number of spectral magnitude parameters that may vary from a number of spectral magnitude parameters in the previous subframe; and the joint quantization accounts for any variation between the number of spectral magnitude parameters in the subframe of the frame and the number of spectral magnitude parameters in the previous subframe; and including the encoder spectral bits in a frame of bits.

2. The method of claim 1, wherein the joint quantization comprises:

computing residual parameters as the difference between the spectral magnitude parameters and the predicted spectral magnitude parameters;

combining the residual parameters from the consecutive subframes within the frame; and quantizing the combined residual parameters into a set of encoder spectral bits.

3. The method of claim 1, wherein the spectral magnitude parameters correspond to a frequency-domain representation of a spectral envelope of the subframe.

4. The method of claim 1, wherein the number of spectral magnitude parameters in the subframe of the frame may vary from a number of spectral magnitude parameters in a second subframe of the frame; and the joint quantization accounts for any variation between the number of spectral magnitude parameters in the subframe of the frame and the number of spectral magnitude parameters in the second subframe of the frame.

5. The method of claim 4, wherein the joint quantization accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint quantization.

6. The method of claim 1, wherein the joint quantization accounts for any variation between the number of spectral magnitude parameters in the subframe of the frame and the number of spectral magnitude parameters in the previous subframe by interpolating and resampling spectral magnitude parameters for the previous subframe and using the interpolated and resampled spectral magnitude parameters in forming the predicted spectral magnitude parameters.

7. The method of claim 1, wherein the joint quantization accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint quantization.

8. A method of encoding speech into a frame of bits, the method including:

digitizing a speech signal into a sequence of digital speech samples;

dividing the digital speech samples into a sequence of subframes, each of the subframes including multiple digital speech samples;

estimating a set of speech model parameters for each subframe, wherein the speech model parameters include a set of spectral magnitude parameters that represent spectral information for the subframe;

combining consecutive subframes from the sequence of subframes into a frame;

jointly quantizing the spectral magnitude parameters from the consecutive subframes of the frame to produce a set of encoder spectral bits, wherein the joint quantization includes forming predicted spectral magnitude parameters from quantized spectral magnitude parameters from a previous frame; and including the encoder spectral bits in a frame of bits;

wherein the joint quantization comprises:

computing residual parameters as the difference between the spectral magnitude parameters and the predicted spectral magnitude parameters;

combining the residual parameters from the consecutive subframes within the frame; and quantizing the combined residual parameters into a set of encoder spectral bits; and combining the residual parameters from the consecutive subframes within the frame comprises:

dividing the residual parameters from each of the subframes into frequency blocks;

performing a linear transformation on the residual parameters within each frequency block to produce a set of transformed residual coefficients for each subframe;

grouping a minority of the transformed residual coefficients from the frequency blocks for each subframe into a prediction residual block average (PRBA) vector for the subframe;

grouping the remaining transformed residual coefficients for each frequency block of each subframe into a higher order coefficient (HOC) vector for the frequency block;

transforming the PRBA vectors to produce a transformed PRBA vector for each subframe;

combining the transformed PRBA vectors for the subframes of the frame by computing generalized sum and difference vectors from the transformed PRBA vectors; and combining the HOC vectors within each frequency block for the subframes of the frame by computing generalized sum and difference vectors from the HOC vectors for each frequency block.

9. The method of claim 1, 2 or 8, further comprising producing additional encoder bits by quantizing additional speech model parameters other than the spectral magnitude parameters.

10. The method of claim 9, wherein the additional speech model parameters include parameters representative of a fundamental frequency and parameters representative of a voicing state.

11. The method of claim 1, 2 or 8, wherein the frame of bits includes redundant error control bits protecting at least some of the encoder spectral bits.

12. The method of claim 1, 2 or 8, wherein the spectral magnitude parameters represent log spectral magnitudes estimated for a Multi-Band Excitation (MBE) speech model.

13. The method of claim 12, wherein the spectral magnitude parameters are estimated from a computed spectrum in a manner which is independent of a voicing state.

14. The method of claim 2 or 8, wherein the predicted spectral magnitude parameters are formed by applying a gain of less than unity to a linear interpolation of quantized spectral magnitudes from a last subframe in a previous frame.

15. The method of claim 8, wherein the transformed residual coefficients are computed for each of the frequency blocks using a Discrete Cosine Transform (DCT) followed by a linear two by two transform on two lowest order DCT coefficients.

16. The method of claim 15, wherein the length of each frequency block is approximately proportional to a number of spectral magnitude parameters within the subframe.

17. The method of claim 2 or 8, wherein quantizing the combined residual parameters includes using at least one vector quantizer.

18. The method of claim 8, wherein quantizing the combined residual parameters includes applying vector quantization to all or part of the generalized sum and difference vectors computed from the transformed PRBA vectors and applying vector quantization to all or part of the generalized sum and difference vectors computed from the HOC vectors.

19. The method of claim 18, wherein the frame includes two consecutive subframes from the sequence of subframes.

20. A speech encoder for encoding speech into a frame of bits, the encoder including:

means for digitizing a speech signal into a sequence of digital speech samples;

means for dividing the digital speech samples into a sequence of subframes, each of the subframes including multiple digital speech samples;

means for estimating a set of speech model parameters for each subframe, wherein the speech model parameters include a set of spectral magnitude parameters that represent spectral magnitude information for the subframe;

means for combining consecutive subframes from the sequence of subframes into a frame;

means for jointly quantizing the spectral magnitude parameters from the consecutive subframes of the frame to produce a set of encoder spectral bits, wherein:

the means for jointly quantizing forms predicted spectral magnitude parameters from quantized spectral magnitude parameters from a previous subframe;

a subframe of the frame includes a number of spectral magnitude parameters that may vary from a number of spectral magnitude parameters in the previous subframe; and the means for jointly quantizing accounts for any variation between the number of spectral magnitude parameters in the subframe of the frame and the number of spectral magnitude parameters in the previous subframe; and means for forming a frame of bits including the encoder spectral bits.

21. The speech encoder of claim 20, wherein the spectral magnitude parameters correspond to a frequency-domain representation of a spectral envelope of the subframe.

22. The speech encoder of claim 20, wherein the number of spectral magnitude parameters in the subframe of the frame may vary from a number of spectral magnitude parameters in a second subframe of the frame; and the means for jointly quantizing accounts for any variation between the number of spectral magnitude parameters in the subframe of the frame and the number of spectral magnitude parameters in the second subframe of the frame.

23. The speech encoder of claim 22, wherein the means for jointly quantizing accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint quantization.

24. The speech encoder of claim 20, wherein the means for jointly quantizing accounts for any variation between the number of spectral magnitude parameters in the subframe of the frame and the number of spectral magnitude parameters in the previous subframe by interpolating and resampling spectral magnitude parameters for the previous subframe and using the interpolated and resampled spectral magnitude parameters in forming the predicted spectral magnitude parameters.

25. The speech encoder of claim 20, wherein the means for jointly quantizing accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint quantization.

26. A method of decoding speech from a frame of bits, the method comprising:

extracting decoder spectral bits from the frame of bits;

using the decoder spectral bits to jointly reconstruct spectral magnitude parameters for consecutive subframes within a frame of speech, wherein the joint reconstruction includes:

inverse quantizing the decoder spectral bits to reconstruct a set of combined residual parameters for the frame from which separate residual parameters for each of the subframes are computed;

forming predicted spectral magnitude parameters from reconstructed spectral magnitude parameters from a previous subframe; and adding the separate residual parameters to the predicted spectral magnitude parameters to form the reconstructed spectral magnitude parameters for each subframe within the frame; wherein a subframe of the frame includes a number of spectral magnitude parameters that may vary from a number of spectral magnitude parameters in the previous subframe; and the joint reconstruction accounts for any variation between the number of spectral magnitude parameters in the subframe of the frame and the number of spectral magnitude parameters in the previous subframe; and synthesizing digital speech samples for each subframe within the frame of speech using speech model parameters which include some or all of the reconstructed voiced/unvoiced metrics and some or all of the reconstructed spectral magnitude parameters for the subframe.

27. The method of claim 26, wherein the spectral magnitude parameters correspond to a frequency-domain representation of a spectral envelope of the subframe.

28. The method of claim 26, wherein the number of spectral magnitude parameters in the subframe of the frame may vary from a number of spectral magnitude parameters in a second subframe of the frame; and the joint reconstruction accounts for any variation between the number of spectral magnitude parameters in the subframe of the frame and the number of spectral magnitude parameters in the second subframe of the frame.

29. The method of claim 28, wherein the joint reconstruction accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint reconstruction.

30. The method of claim 26, wherein the joint reconstruction accounts for any variation between the number of spectral magnitude parameters in the subframe of the frame and the number of spectral magnitude parameters in the previous subframe by interpolating and resampling spectral magnitude parameters for the previous subframe and using the interpolated and resampled spectral magnitude parameters in forming the predicted spectral magnitude parameters.

31. The method of claim 26, wherein the joint reconstruction accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint reconstruction.

32. A method of decoding speech from a frame of bits, the method comprising:

extracting decoder spectral bits from the frame of bits;

using the decoder spectral bits to jointly reconstruct spectral magnitude parameters for consecutive subframes within a frame of speech, wherein the joint reconstruction includes;

inverse quantizing the decoder spectral bits to reconstruct a set of combined residual parameters for the frame from which separate residual parameters for each of the subframes are computed;

forming predicted spectral magnitude parameters from reconstructed spectral magnitude parameters from a previous frame; and adding the separate residual parameters to the predicted spectral magnitude parameters to form the reconstructed spectral magnitude parameters for each subframe within the frame; and synthesizing digital speech samples for each subframe within the frame of speech using speech model parameters which include some or all of the reconstructed spectral magnitude parameters for the subframe;

wherein the computing of the separate residual parameters for each subframe from the combined residual parameters for the frame comprises:

dividing each subframe into frequency blocks;

separating the combined residual parameters for the frame into generalized sum and difference vectors representing transformed PRBA vectors combined across the subframes of the frame, and into generalized sum and difference vectors representing HOC vectors for the frequency blocks combined across the subframes of the frame;

computing PRBA vectors for each subframe from the generalized sum and difference vectors representing the transformed PRBA vectors;

computing HOC vectors for each subframe from the generalized sum and difference vectors representing the HOC vectors for each of the frequency blocks;

combining the PRBA vector and the HOC vectors for each of the frequency blocks to form transformed residual coefficients for each of the subframes; and performing an inverse transformation on the transformed residual coefficients to produce the separate residual parameters for each subframe of the frame.

33. The method of claim 26, or 32, wherein the frame of bits includes other decoder bits in addition to the decoder spectral bits, wherein the other decoder bits are representative of speech model parameters other than the spectral magnitude parameters.

34. The method of claim 33, wherein the speech model parameters include parameters representative of a fundamental frequency and parameters representative of a voicing state.

35. The method of claim 26 or 32, wherein the reconstructed spectral magnitude parameters represent log spectral magnitudes used in a Multi-Band Excitation (MBE) speech model.

36. The method of claim 26 or 32, wherein the frame of bits includes redundant error control bits protecting at least some of the decoder spectral bits.

37. The method of claim 26 or 32, wherein the synthesizing of speech for each subframe includes computing a set of phase parameters from the reconstructed spectral magnitude parameters.

38. The method of claim 26 or 32, wherein the predicted spectral magnitude parameters are formed by applying a gain of less than unity to a linear interpolation of quantized spectral magnitudes from a last subframe of a previous frame.

39. The method of claim 32, wherein the separate residual parameters are computed from the transformed residual coefficients by performing on each of the frequency blocks an inverse linear two by two transform on the two lowest order transformed residual coefficients within the frequency block and then performing an Inverse Discrete Cosine Transform (IDCT) over all the transformed residual coefficients within the frequency block.

40. The method of claim 39, wherein four of the frequency blocks are used per subframe and wherein the length of each frequency block is approximately proportional to a number of spectral magnitude parameters within the subframe.

41. The method of claims 26 or 32, wherein the inverse quantization to reconstruct a set of combined residual parameters for the frame includes using inverse vector quantization applied to one or more vectors.

42. A decoder for decoding speech from a frame of bits, the decoder including:

means for extracting decoder spectral bits from the frame of bits;

means for using the decoder spectral bits to jointly reconstruct spectral magnitude parameters for consecutive subframes within a frame of speech, wherein the joint reconstruction includes:

inverse quantizing the decoder spectral bits to reconstruct a set of combined residual parameters for the frame from which separate residual parameters for each of the subframes are computed;

forming predicted spectral magnitude parameters from reconstructed spectral magnitude parameters from a previous subframe; and adding the separate residual parameters to the predicted spectral magnitude parameters to form the reconstructed spectral magnitude parameters for each subframe within the frame; wherein a subframe of the frame includes a number of spectral magnitude parameters that may vary from a number of spectral magnitude parameters in the previous subframe; and the joint reconstruction accounts for any variation between the number of spectral magnitude parameters in the subframe of the frame and the number of spectral magnitude parameters in the previous subframe; and means for synthesizing digital speech samples for each subframe within the frame of speech using speech model parameters which include some or all of the reconstructed spectral magnitude parameters for the subframe.

43. The method of claim 42, wherein the speech level parameter for each subframe is estimated as a mean of a set of spectral magnitude parameters computed for each subframe plus an offset.

44. The method of claim 43, wherein the spectral magnitude parameters represent log spectral magnitudes estimated for a Multi-Band Excitation (MBE) speech model.

45. The method of claim 43, wherein the offset is dependent on a number of spectral magnitude parameters in the frame.

46. The decoder of claim 42, wherein the spectral magnitude parameters correspond to a frequency-domain representation of a spectral envelope of the subframe.

47. The decoder of claim 42, wherein the number of spectral magnitude parameters in the subframe of the frame may vary from a number of spectral magnitude parameters in a second subframe of the frame; and the joint reconstruction accounts for any variation between the number of spectral magnitude parameters in the subframe of the frame and the number of spectral magnitude parameters in the second subframe of the frame.

48. The decoder of claim 47, wherein the joint reconstruction accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint reconstruction.

49. The decoder of claim 42, wherein the joint reconstruction accounts for any variation between the number of spectral magnitude parameters in the subframe of the frame and the number of spectral magnitude parameters in the previous subframe by interpolating and resampling spectral magnitude parameters for the previous subframe and using the interpolated and resampled spectral magnitude parameters in forming the predicted spectral magnitude parameters.

50. The decoder of claim 42, wherein the joint reconstruction accounts for any variation between the number of spectral magnitude parameters in a subframe of the frame and the number of spectral magnitude parameters in a second subframe of the frame by transforming the spectral magnitude parameters for the two subframes to produce one or more output vectors and limiting the number of elements within each output vector that are used in the joint reconstruction.

51. A method of encoding a level of speech into a frame of bits, the method comprising:

digitizing a speech signal into a sequence of digital speech samples;

dividing the digital speech samples into a sequence of subframes, each of the subframes including multiple digital speech samples;

estimating a speech level parameter for each of the subframes, wherein the speech level parameter is representative of the amplitude of the digital speech samples comprising the subframe;

combining a plurality of consecutive subframes from the sequence of subframes into a frame;

jointly quantizing the speech level parameters from the plurality of consecutive subframes within the frame, characterized in that the joint quantization includes computing and quantizing an average level parameter by combining the speech level parameters over the subframes within the frame, and computing and quantizing a difference level vector between the speech level parameters for each subframe within the frame and the average level parameter; and including quantized bits representative of the average level parameter and the difference level vector in a frame of bits.

52. The method of claim 51 or 43, wherein the difference level vector is quantized using vector quantization.

53. The method of claim 51 or 43, wherein the frame of bits includes error control bits used to protect some or all of the quantized bits representative of the average level parameter and the difference level vector.

54. The method of claim 51, wherein the spectral magnitude parameters correspond to a frequency-domain representation of a spectral envelope of the subframe.

* * * * *

UNITED STATES PATENT AND TRADEMARK OFFICE

CERTIFICATE OF CORRECTION

PATENT NO. : 6,161,089 
DATED : December 12, 2000
INVENTOR(S) : John C. Hardwick It is certified that error appears in the above-identified patent and that said Letters Patent is hereby corrected as shown below:

Title page,
Item [56], References Cited, U.S. PATENT DOCUMENTS, “5,067,158” “Arjmad” should be -- Arjmand --; 5,091,944,”, Takahasi” should be -- Takahashi --.
OTHER PUBLICATIONS, “Campbell” reference, “Speeh” should be -- Speech --; and “Chen et al.” reference, “Postifiltering” should be -- Postfiltering --.

Column 11,
Lines 10 and 12, “1a” should be -- 1a --.
Line 64, before “consisting”, insert -- ( --.

Column 13,
Line 16, Equation, the first “x” should be -- z --.
Line 37, Equation, “Z” should be -- z --.

Column 14,
Line 34, $Z_m$” should be -- $z_m$ --.

Column 17,
Approximately line 3, title of table, should be -- Table A of Gain VQ Codebook (5 Bit) Values --.
Approximately line 37, title of table, should be -- Table B of PRBA Sum[1,2] VQ Codebook (8 Bit) Values --. The title also appears at Column 18, line 3, Column 19, line 3, and Column 20, line 3.
Table B at 25, “-236” should be -- -235 --.

Column 18,
Table B, at 54, "-375" should be -- -675 --.

Column 19,
Table B, at 129, "438" should be -- 439 --.
Table B, at 130, "-658" should be -- -358 --.
Table B, at 146, "842" should be -- 642 --.
Table B, at 158, "936" should be -- 836 --.

Column 20,
Table B, at 194, "-657" should be -- -658 --.

Column 21,
Approximately line 3, title of table should be -- Table C of PRBA Sum[3,4] VQ Codebook (6 Bit) Values --.

UNITED STATES PATENT AND TRADEMARK OFFICE

CERTIFICATE OF CORRECTION

PATENT NO. : 6,161,089
DATED : December 12, 2000
INVENTOR(S) : John C. Hardwick

It is certified that error appears in the above-identified patent and that said Letters Patent is hereby corrected as shown below:

Column 21,
Table C, at 13, “-65” should be -- -66 --.
Approximately line 37, Title of table, should be --Table D of PRBA Sum[5,7] VQ Codebook (7 Bi Values--. The title also appears at Column 22, line 3, and Column 23, line 3.
Table D, at 9, “-245” should be -- -345 --.

Column 22,
Table D, at 24, “-268” should be -- -368 --.
Table D, at 62, “263” should be -- 253 --.
Table D, at 66, “-153” should be -- -152 --.
Table D, delete the duplicate line "104 458 168 -29".
Table D, at 106, "369" should be -- 269 --.

Column 23,
Table D, at 119, "1595" should be -- 159 --.
Table D, at 124, "585" should be -- 565 --.
Title of table at approximately line 38, should be -- Table E of PRBA Dif[1,3] VQ Codebook (8 Bit) Values --. The title also appears at Column 24, line 3, Column 25, line 3, and Column 26, line 3.
Table E, at 36, "-349" should be -- -249 --.

Column 24,
Table E, at 60, "3040" should be -- 304 --.
Table E, at 82, "603" should be -- 602 --.

Column 25,
Table E, at 126, "256" should be -- 356 --.
Table E, at 167, "-550" should be -- -50 --.
Table E, at 173, "-24" should be -- -245 --.

UNITED STATES PATENT AND TRADEMARK OFFICE

CERTIFICATE OF CORRECTION

PATENT NO. : 6,161,089
DATED : December 12, 2000
INVENTOR(S) : John C. Hardwick

It is certified that error appears in the above-identified patent and that said Letters Patent is hereby corrected as shown below:

Column 26,
Title of table at approximately line 62, should be -- Table F of PRBA Dif[1,3] VQ Codebook (8 Bit) Values --. The title also appears at Column 27, line 3.

Column 27,
Title of table at approximately line 61, should be -- Table G of HCO Sum0 VQ Codebook (7 Bit) Values --. The title also appears at Column 28, line 3 and Column 29, line 3.

Column 28,
Table G, at 17, "-170" should be -- -1170 --.
Table G, at 29, "5" should be --94-- and "229" should be -- 118 --.
Table G, at 38, "3341" should be -- 341 -- and "-440" should be -- -441 --.
Table G, at 41, "-49" should be -- 211 --, "147" should be -- 245 --, and "-411" should be -- -199 --.

Column 29,
Title of table at approximately line 56, should be -- Table H of HOC Dif0 VQ Codebook (3 Bit) Values --. The title also appears at Column 28, line 3 and Column 29, line 3.

Column 30,
Title of table at approximately line 4, should be -- Table I of HOC Sum 1 VQ Codebook (7 Bit) Values --. The title also appears at Column 31, line 4.
Table 1, at 13, “-100” should be -- 299 --.

Column 31,
Title of table approximately line 56, should be -- Table J of HOC Dif1 VQ Codebook (3 Bit) Values --.

Column 32,
Table J, at 65, “-389” should be -- -289 --.

Column 33,
Title of table at approximately line 4, should be -- Table K of HOC Sum2 VQ Codebook (7 Bit) Values --.
Table K, at 114, "114" should be -- 112 --.
Title of table at approximately line 56, should be -- Table L of HOC Dif2 VQ Codebook (3 Bit) Values --.

UNITED STATES PATENT AND TRADEMARK OFFICE

CERTIFICATE OF CORRECTION

PATENT NO. : 6,161,089
DATED : December 12, 2000
INVENTOR(S) : John C. Hardwick

It is certified that error appears in the above-identified patent and that said Letters Patent is hereby corrected as shown below:

Column 34,
Title of table at approximately line 4, should be -- Table M of HOC Sum3 VQ Codebook (7 Bit) Values -. The title also appears at Column 35, line 4.
Table M, at 19, "-3550" should be -- -350 --.

Column 35,
Table M, at 125, "050" should be -- 505 --.

Column 35,
Title of table at approximately line 56, should be -- Table N of HOC Dif3 VQ Codebook (3 Bit) Values --.

Column 36,
Title of table at approximately line 4, should be -- Table O of Frequency Block Sizes --
Line 38 is missing. Insert the following: -- 38 8 9 10 11 --

Signed and Sealed this

Thirty-first Day of August, 2004

JON W. DUDAS
*Director of the United States Patent and Trademark Office*